US008992292B2

(12) United States Patent
Suetomi et al.

(10) Patent No.: US 8,992,292 B2
(45) Date of Patent: Mar. 31, 2015

(54) COIN PROCESSING DEVICE

(71) Applicant: Oki Electric Industry Co., Ltd., Tokyo (JP)

(72) Inventors: Kazuo Suetomi, Tokyo (JP); Tatsuya Yano, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/372,447

(22) PCT Filed: Nov. 28, 2012

(86) PCT No.: PCT/JP2012/080787
§ 371 (c)(1),
(2) Date: Jul. 15, 2014

(87) PCT Pub. No.: WO2013/108492
PCT Pub. Date: Jul. 25, 2013

(65) Prior Publication Data

US 2015/0011145 A1 Jan. 8, 2015

(30) Foreign Application Priority Data

Jan. 16, 2012 (JP) ..... 2012-005964

(51) Int. Cl.
*G07D 1/00* (2006.01)
*G07D 3/14* (2006.01)

(52) U.S. Cl.
CPC ..... *G07D 3/14* (2013.01)
USPC ..... 453/57; 453/6; 453/12; 453/33; 453/49

(58) Field of Classification Search
USPC ..... 453/6, 10, 12, 13, 33–35, 49, 57
See application file for complete search history.

(56) References Cited

U.S. PATENT DOCUMENTS

| | | | |
|---|---|---|---|
| 2002/0058471 | A1 | 5/2002 | Hino et al. |
| 2002/0162724 | A1 | 11/2002 | Hino et al. |
| 2004/0238320 | A1 | 12/2004 | Hino et al. |
| 2004/0259490 | A1 | 12/2004 | Hino et al. |
| 2007/0144864 | A1 | 6/2007 | Harada et al. |

FOREIGN PATENT DOCUMENTS

| | | | |
|---|---|---|---|
| JP | 2002-150348 | A | 5/2002 |
| JP | 2007-172478 | A | 7/2007 |
| JP | 2009-157823 | A | 7/2009 |
| JP | 2011-108100 | A | 6/2011 |

*Primary Examiner* — Jeffrey Shapiro
(74) *Attorney, Agent, or Firm* — Rabin & Berdo, P.C.

(57) ABSTRACT

A coin processing device includes a rotating member that has an annular rib provided annularly along a circumferential direction on the outer peripheral portion, which transports a coin upon a transport path using a cutout portion formed upon a lower portion of the annular rib. An open position intersects the annular rib. An opening and closing member, when positioned at the open position, is positioned adjacent to the annular rib in a radial direction of the rotating member so as to allow rotation of the rotating member.

8 Claims, 22 Drawing Sheets

COIN PROCESSING DEVICE

TECHNICAL FIELD

The present invention relates to a coin processing device, and more specifically relates to a coin processing device that conveys coins and ejects the coins through predetermined ejection apertures.

BACKGROUND ART

Coin processing devices that manage coins are used in, for example, cash registers installed in stores and the like. A coin processing device, after receiving coins, carries out coin verification and identifies the denominations of the coins. The coin processing device separates the coins in accordance with the identification results and ejects the coins through predetermined ejection apertures.

In order to selectively eject coins, the above-mentioned coin processing device includes, for example: a rotary member that conveys coins along a conveyance path by rotating; ejection apertures provided on the conveyance path, through which the coins drop; and opening-and-closing members that open and close the ejection apertures. A coin conveyed by the rotary member drops and is ejected in a state in which an ejection aperture is opened up by the opening-and-closing member (for example, see Patent Document 1 (Japanese Patent Application Laid-Open (JP-A) No. 2011-108100)).

DISCLOSURE OF INVENTION

Technical Problem

In recent years, coin processing devices have been required to process large quantities of coins. As a consequence, there are calls for coins to be conveyed more quickly by the rotary member and for the coins to be more rapidly ejected through the ejection apertures.

Accordingly, the present invention has been made in consideration of the situation described above, and an object of the present invention is to provide a new and improved coin processing device that is capable of rapidly ejecting coins conveyed by a rotary member through ejection apertures during rotation of the rotary member.

Solution to Problem

In order to solve the problem described above, according to one aspect of the present invention, a coin processing device is provided that includes: a rotary member that conveys a coin along a conveyance path by rotating; an ejection aperture disposed at the conveyance path, through which the coin being conveyed by the rotary member drops; and an opening-and-closing member that turns about a turning shaft between a closed position, at which the opening-and-closing member closes the ejection aperture, and an open position, at which the ejection aperture is opened up such that the coin drops therein, the turning shaft being disposed at a conveyance direction downstream side of the ejection aperture, wherein the rotary member includes an annular rib that is disposed in an annular shape along a circumferential direction at an outer periphery portion of the rotary member, the coin being conveyed along the conveyance path by an indentation portion formed in a floor portion of the annular rib, the open position is a position at which the opening-and-closing member crosses the annular rib, and when the opening-and-closing member is disposed at the open position, the opening-and-closing member is disposed in a vicinity of the annular rib in the radial direction of the rotary member and the opening-and-closing member allows rotation of the rotary member.

In this coin processing device, the opening-and-closing member turns about the turning shaft at the conveyance direction downstream side of the ejection aperture, and is disposed at the open position crossing the annular rib. Therefore, it is easy for a coin to drop into the ejection aperture even while the opening-and-closing member is turning from the closed position to the open position. Furthermore, when disposed in the open position, the opening-and-closing member is disposed adjacent to the annular rib in the radial direction of the rotary member and allows the rotation of the rotary member. Therefore, because the rotation of the rotary member may continue even when the opening-and-closing member is disposed at the open position, a coin may be dropped through the ejection aperture while the rotary member is rotating. Thus, according to the coin processing device described above, coins being conveyed by the rotary member may be rapidly ejected through the ejection apertures during rotation of the rotary member.

The opening-and-closing member may include: a first opening-and-closing plate that is disposed at the center side in the radial direction of the rotary member relative to the annular rib; and a second opening-and-closing plate that is disposed at the outer side in the radial direction relative to the annular rib, wherein, when the first opening-and-closing plate and the second opening-and-closing plate are at the open position, the first opening-and-closing plate and the second opening-and-closing plate cross the annular rib.

The indentation portion may include: a coin conveyance portion that is indented to a predetermined depth and conveys the coin; and a release portion at a portion of the coin conveyance portion at the conveyance direction upstream side thereof, the release portion being indented more deeply than the coin conveyance portion, and it being possible for a portion of the coin to enter the release portion when the coin is tipping and dropping at the ejection aperture.

The indentation portion may be plurally provided in the annular rib at predetermined intervals along the circumferential direction, and the annular rib may further include a second indentation portion disposed between neighboring the indentation portions in the circumferential direction, an indentation amount of the second indentation portion being smaller than the indentation amount of the indentation portions.

The ejection aperture may be a first ejection aperture at which authentic coins are ejected, and the coin processing device may further include: a second ejection aperture that is disposed at the conveyance direction upstream side in the circumferential direction relative to the first ejection aperture, at least one of reject coins and foreign bodies being ejected at the second ejection aperture; and a third ejection aperture that is disposed at the conveyance direction downstream side in the circumferential direction relative to the first ejection aperture, coins that have not been ejected at the first ejection aperture being ejected at the third ejection aperture.

The coin processing device may further include: an optical sensor disposed between the second ejection aperture and the first ejection aperture in the circumferential direction, the optical sensor being capable of detecting at least one of reject coins and foreign bodies intended to be ejected at the second ejection aperture; and a magnetic sensor disposed between the first ejection aperture and the third ejection aperture in the circumferential direction, the magnetic sensor being capable of detecting authentic coins intended to be ejected at the first ejection aperture.

The coin processing device may further include an adhesive member in which an adhesive layer is formed on a base material, wherein the adhesive member is adhered to the annular rib, via the adhesive layer, so as to cover an outer periphery of the annular rib.

The rotary member, the ejection aperture and the opening-and-closing member may structure a portion of a separation unit that separates coins, the coin processing device may further include a verification unit that verifies the coins to be separated by the separation unit, and the separation unit may further include a feed-in aperture through which the coins verified by the verification unit are fed in.

Advantageous Effects of Invention

As described hereabove, according to the present invention, coins conveyed by a rotary member may be rapidly ejected through ejection apertures during rotation of the rotary member.

BEST MODE FOR CARRYING OUT THE INVENTION

Herebelow, preferable embodiments of the present invention are described in detail while referring to the attached drawings. In the present specification and drawings, structural elements with substantially the same functional structures are assigned the same reference symbols, and duplicative descriptions thereof are omitted accordingly.

1. First Embodiment 1-1. Structure of the Coin Processing Device

Figure 1:
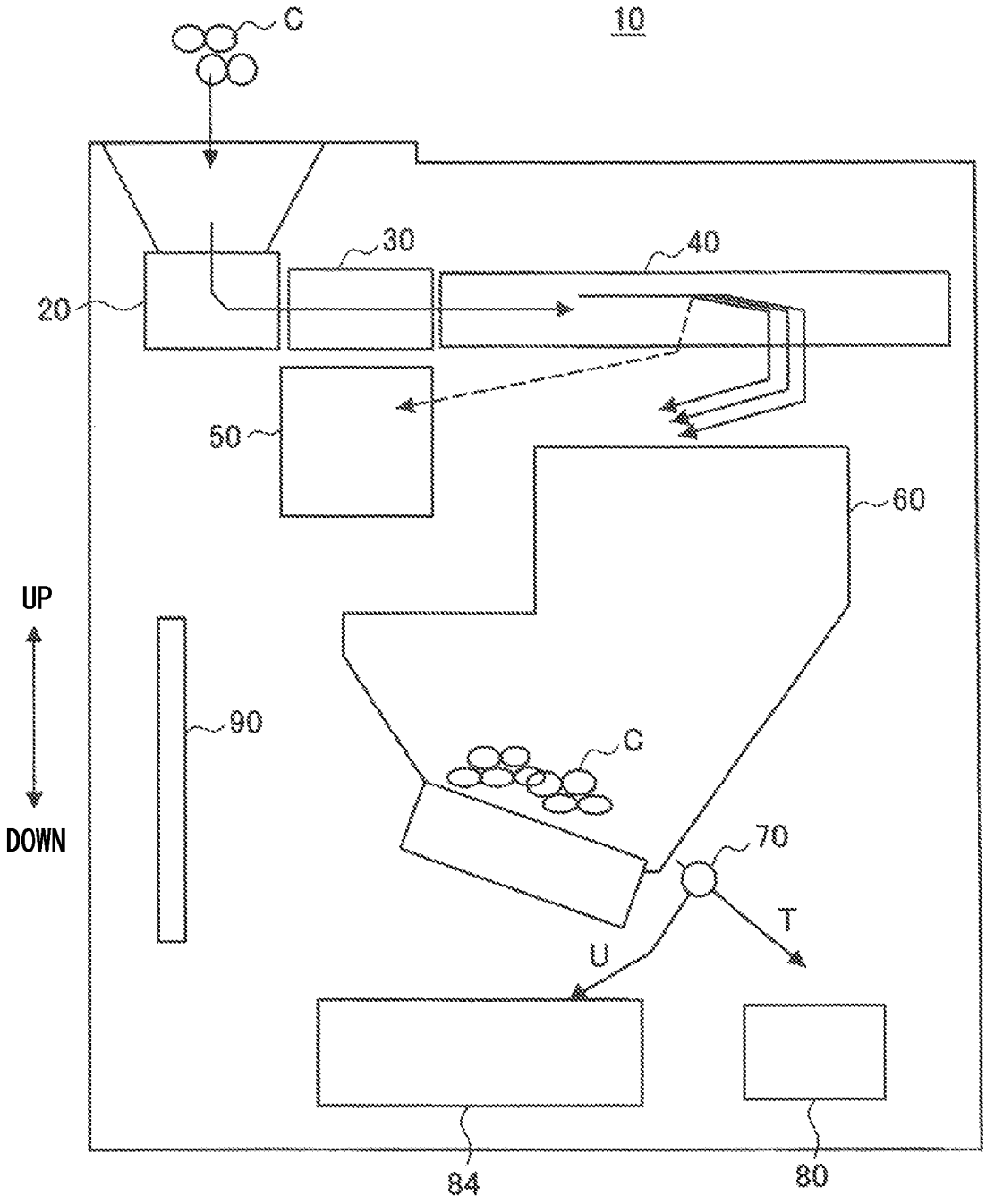
FIG. 1 is a schematic sectional diagram in which a coin processing device 10 in accordance with a first embodiment is seen in a front view.
Figure 2:
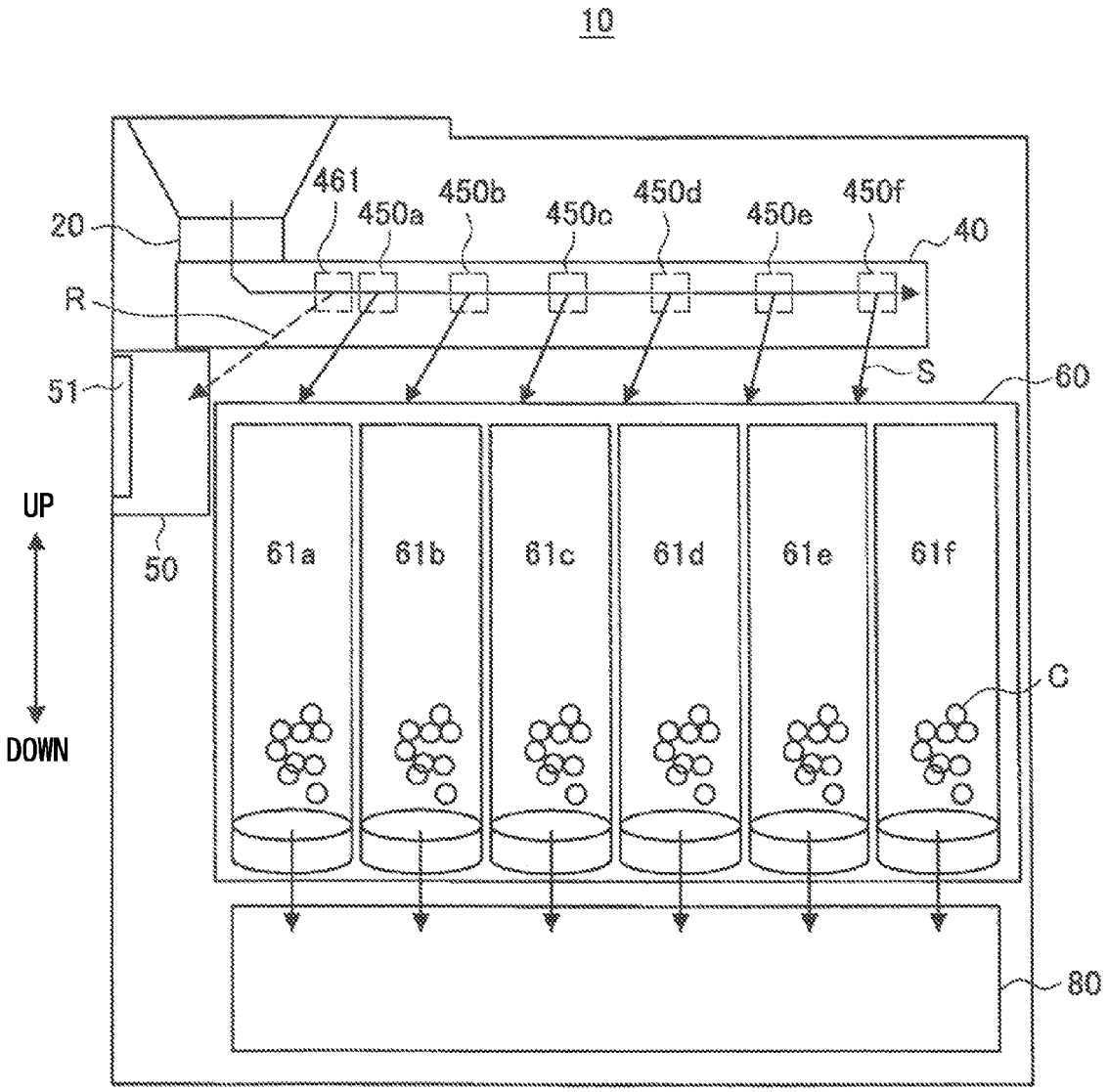
FIG. 2 is a schematic sectional diagram in which the coin processing device 10 in accordance with the first embodiment is seen in a side view.

The structure of a coin processing device 10 according to a first embodiment is described referring to FIG. 1 and FIG. 2. FIG. 1 is a schematic sectional diagram in which the coin processing device 10 in accordance with the first embodiment is seen in a front view. FIG. 2 is a schematic sectional diagram in which the coin processing device 10 in accordance with the first embodiment is seen in a side view.

The coin processing device 10 manages coins that are being administered by, for example, a cash register installed in a shop or the like. After receiving a batch of coins, the coin processing device 10 performs coin verification of the coins and identifies the denominations thereof. Thereafter, the coin processing device 10 separates the coins into the respective denominations in accordance with the identification results, and pays out separated coins.

As shown in FIG. 1 and FIG. 2, the coin processing device 10 includes: a coin feeding section 20; a coin verification section 30, which is an example of a verification unit; a coin separation section 40, which is an example of a separation unit; a reject coin accommodation section 50; a denomination separation hopper 60; a conveyance gate 70; a coin payout box 80; a coin recovery vault 84; and a control unit 90.

The coin feeding section 20 receives and temporarily accommodates an inserted batch of coins C. The coin feeding section 20 feeds the accommodated coins C to the coin verification section 30 one at a time. Detailed structure of the coin feeding section 20 is described below.

The coin verification section 30 performs verifications of the coins C that have been fed from the coin feeding section 20. For example, the coin verification section 30 identifies whether the coins are authentic or counterfeit, denominations of the coins, and the like. The coin verification section 30 conveys the verified coins C to the coin separation section 40. Detailed structure of the coin verification section 30 is described below.

The coin separation section 40, while conveying the coins C, separates and ejects the coins C on the basis of the verification results from the coin verification section 30. As shown in FIG. 2, the coin separation section 40 includes a reject aperture 461 and coin ejection apertures 450*a* to 450*f*. The reject aperture 461 is an ejection aperture that ejects reject coins verified as being counterfeit, foreign bodies such as trash and the like, and suchlike. The coin ejection apertures 450*a* to 450*f* are ejection apertures that eject normal coins verified as authentic, in their respective denominations. The meaning of the term "denominations" is, as an example, the six denominations of Japanese coins: 1 yen, 5 yen, 10 yen, 50 yen, 100 yen and 500 yen. Detailed structure of the coin separation section 40 is described below.

The reject coin accommodation section 50 accommodates the reject coins and foreign bodies such as trash and the like that have passed through the reject aperture 461. The reject coin accommodation section 50 includes a door 51, which can be opened and closed, in a front face of the coin processing device 10. An operator opens the door 51 to collect the reject coins and the like accommodated inside the reject coin accommodation section 50.

The denomination separation hopper 60 accommodates the normal coins that have passed through the coin ejection apertures 450*a* to 450*f*, separated by denomination. Six hoppers (denomination hoppers 61*a* to 61*f*) are provided in the present embodiment to serve as the denomination separation hopper 60. As shown in FIG. 2, the respective denomination hoppers 61*a* to 61*f* are arranged in a row below the coin ejection apertures 450*a* to 450*f* of the corresponding denominations. The denomination hoppers 61*a* to 61*f* include feeding units that feed the coins C to the conveyance gate 70 one coin at a time.

The conveyance gate 70 is provided in correspondence with each of the denomination hoppers 61*a* to 61*f*. Conveyance destinations of the coins C fed from the denomination hoppers 61*a* to 61*f* branch from the conveyance gate 70. The conveyance destinations between which the conveyance gate 70 branches are the route marked with arrow T and the route marked with arrow U in FIG. 1.

The coin payout box 80 accommodates coins to be paid out. Coins that are conveyed along the route of arrow T by the conveyance gate 70 are accommodated in the coin payout box 80. The coin payout box 80 may include plural smaller boxes that accommodate coins of the different denominations.

The coin recovery vault 84 accommodates coins to be recovered. Coins conveyed along the route of arrow U by the conveyance gate 70 are accommodated in the coin recovery vault 84.

The control unit 90 controls overall operations of the coin processing device 10. The control unit 90 includes a control section (not shown in the drawings) that controls operations of the respective structural elements described above, and a storage section (not shown in the drawings) that stores programs to be executed by the control section, various kinds of data and so forth.

1-2. Detailed Structure of the Coin Feeding Section 20

Figure 3:
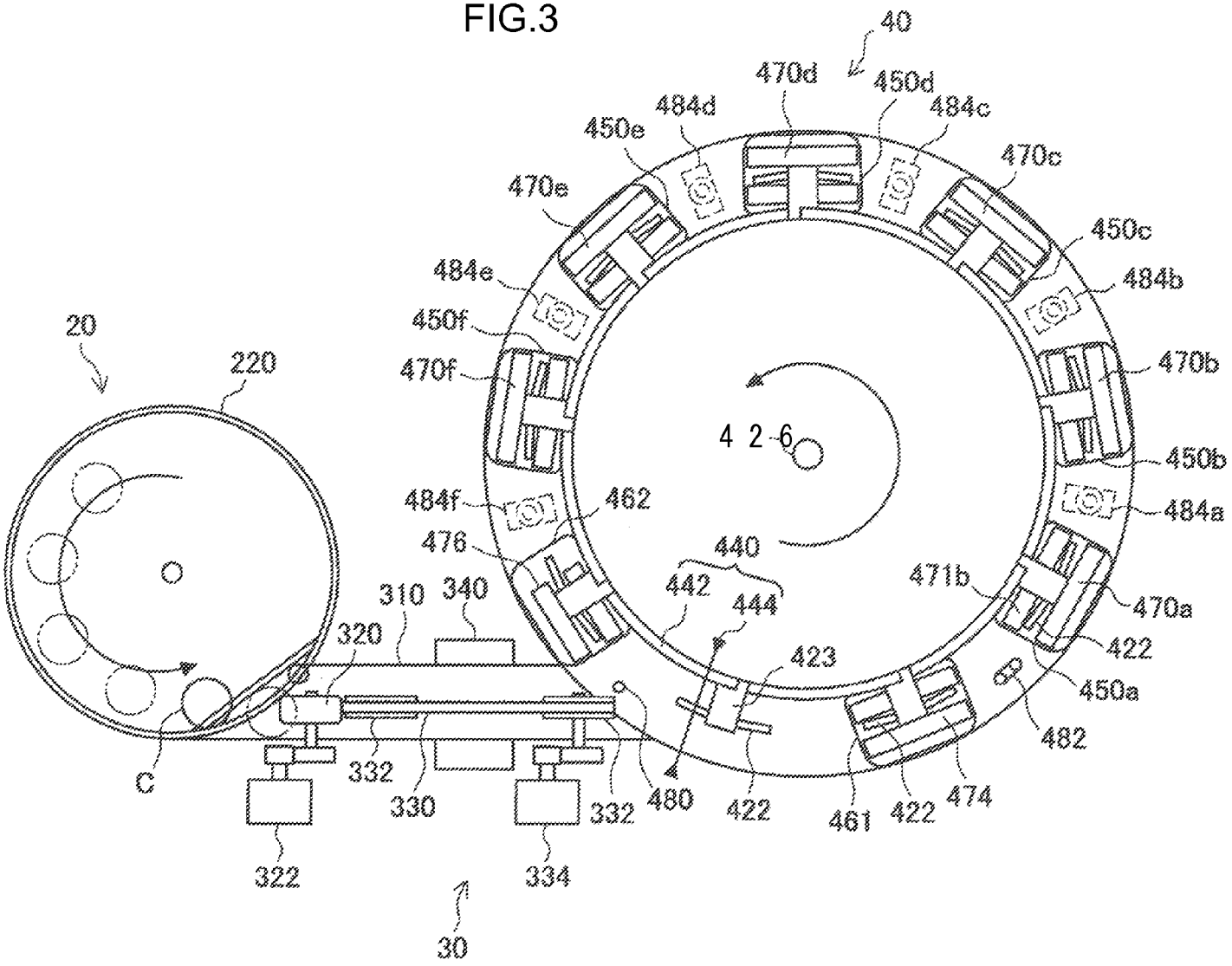
FIG. 3 is a schematic plan diagram showing a coin feeding section 20, a coin verification section 30 and a coin separation section 40 in accordance with the first embodiment.
Figure 4:
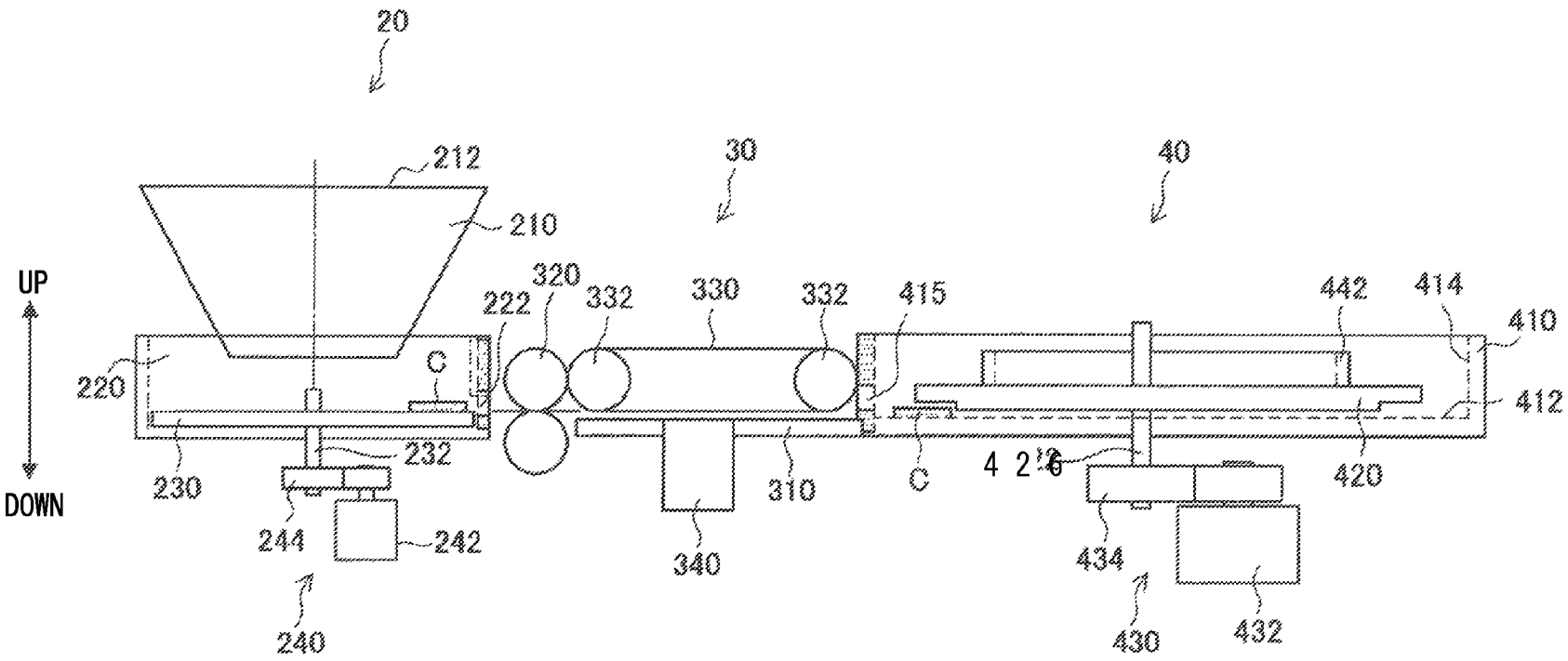
FIG. 4 is a schematic sectional diagram showing the coin feeding section 20, coin verification section 30 and coin separation section 40 in accordance with the first embodiment.

Detailed structure of the coin feeding section 20 according to the first embodiment is described referring to FIG. 3 and FIG. 4. FIG. 3 is a schematic plan diagram showing the coin feeding section 20, coin verification section 30 and coin separation section 40 in accordance with the first embodiment. FIG. 4 is a schematic sectional diagram showing the coin feeding section 20, coin verification section 30 and coin separation section 40 in accordance with the first embodiment.

The coin feeding section 20 receives the coins C that are inputted as a batch, and feeds the coins one at a time to the coin verification section 30. As shown in FIG. 3 and FIG. 4, the coin feeding section 20 includes a coin receiving portion 210, an accommodation portion 220, a turning disc 230 and a disc driving section 240.

The coin receiving portion 210 is a portion that accepts the coins C inputted to the coin feeding section 20. The coin receiving portion 210 includes an insertion aperture 212 at which the coins C are inserted. The coins C inserted through the insertion aperture 212 drop into the accommodation portion 220 under gravity. The insertion aperture 212 opens widely such that a large quantity of coins C may be easily inserted as a batch.

The accommodation portion 220 is a portion that accommodates the coins C that have dropped through the coin receiving portion 210. The turning disc 230 is disposed inside the accommodation portion 220 (in an accommodation space). An inner periphery face of the accommodation portion 220 is formed in a shape that runs along the outer periphery of the turning disc 230, such that the turning disc 230 may be turned. The accommodation portion 220 is capable of accommodating a predetermined quantity of coins C. A passage aperture 222 is provided in a side face of the accommodation portion 220, so as to direct the coins C to the coin verification section 30. The passage aperture 222 is formed with a width and height such that the coins C may pass therethrough one at a time.

The turning disc 230 is a member with a circular shape that is disposed inside the accommodation portion 220. The turning disc 230 introduces the coins to the coin verification section 30 by rotating. The turning disc 230 is disposed directly below the coin receiving portion 210, and the coins in the coin receiving portion 210 fall onto the turning disc 230. The turning disc 230 receives a rotary driving force from the disc driving section 240 and turns in a predetermined rotation direction. The coins on the turning disc 230 are subject to a centrifugal force generated by the rotation of the turning disc 230, move toward the side wall face of the accommodation portion 220 (the outer periphery side of the turning disc 230), and pass through the passage aperture 222.

The disc driving section 240 is a driving section that causes the turning disc 230 to rotate in the predetermined rotation direction. The disc driving section 240 includes a disc motor 242 and a gear train 244. The disc motor 242 transmits rotary driving force through the gear train 244, causing a rotary shaft 232 that is attached to the turning disc 230 to rotate. Hence, the turning disc 230 rotates in the same direction as the rotation direction of the rotary shaft 232.

1-3. Detailed Structure of the Coin Verification Section 30

Detailed structure of the coin verification section 30 according to the first embodiment is described referring to FIG. 3 and FIG. 4.

The coin verification section 30 performs verifications of the coins C that have been fed from the coin feeding section 20. As shown in FIG. 3 and FIG. 4, the coin verification section 30 includes a conveyance path 310, feeding rollers 320, a conveyance belt 330 and a verification sensor 340.

The conveyance path 310 is disposed between the coin feeding section 20 and the coin separation section 40, and is a path along which the coins C are conveyed. The conveyance path 310 is, for example, a plate-shaped conveyance plate, and includes a conveyance surface that conveys the coins C.

The feeding rollers 320 are a pair of rollers that feed the coins C that have passed through the passage aperture 222 of the coin feeding section 20 toward the conveyance belt 330. The feeding rollers 320 receive driving force from a feeding driving section 322, and nip and convey the coins C one at a time.

The conveyance belt 330 conveys the coins C by turning in a state in which a coin C fed by the feeding rollers 320 is sandwiched against the conveyance surface of the conveyance path 310. The conveyance belt 330 is tensed between a pair of pulleys 332. The pulleys 332 receive driving force from a belt driving section 334 and rotate, and the conveyance belt 330 turns in conjunction with the rotation of the pulleys 332.

The verification sensor 340 verifies the authenticity and denomination of each coin C during the conveyance thereof by the conveyance belt 330. In concrete terms, the verification sensor 340 verifies whether a coin C is authentic or counterfeit by identifying the diameter, material and thickness of the coin C, whether or not there is a hole in the middle of the coin C, and so forth. The verification sensor 340 is, for example, an optical sensor. As well as denominations of the coins C, the verification sensor 340 identifies foreign bodies such as trash and the like.

The verification sensor 340 outputs the verification results to the control unit 90. On the basis of the verification results from the verification sensor 340, the control unit 90 performs control to separate verified coins at the coin separation section 40 and eject the coins through the reject aperture and the coin ejection apertures.

1-4. Detailed Structure of the Coin Separation Section 40

Detailed structure of the coin separation section 40 according to the first embodiment is described referring to FIG. 3 and FIG. 4.

The coin separation section 40, while conveying the coins C, separates and ejects the coins C on the basis of the verification results from the coin verification section 30. As shown in FIG. 3 and FIG. 4, the coin separation section 40 includes: a separation housing 410; a rotary disc 420, which is an example of a rotary member; a disc driving section 430; a position detection section 440; the coin ejection apertures 450*a* to 450*f*, which are examples of a first ejection aperture; the first reject aperture 461, which is an example of a second ejection aperture; and a second reject aperture 462, which is an example of a third ejection aperture. The coin separation section 40 further includes: ejection aperture opening-and-closing plates 470*a* to 470*f*, which are examples of an opening-and-closing member; a reject aperture opening-and-closing plate 474; a reject aperture guide 476; a feed-in detection sensor 480; a foreign body detection sensor 482; and coin detection sensors 484*a* to 484*f*.

The Separation Housing 410

As shown in FIG. 4, the separation housing 410 is a circular tube-shaped member. The separation housing 410 is structured by a housing floor face 412 and a side wall 414. The housing floor face 412 is specified to be at substantially the same position as the conveyance surface of the conveyance path 310 of the coin verification section 30. Therefore, coins that have been conveyed along the conveyance path 310 can be easily fed in to the separation housing 410.

A feed-in aperture 415 is formed in the side wall 414. After the verification by the verification sensor 340, a coin that has been conveyed by the conveyance belt 330 is fed in through the feed-in aperture 415. As is described in more detail below, the coin ejection apertures 450*a* to 450*f*, the first reject aperture 461, and the second reject aperture 462 are formed in the housing floor face 412.

The Rotary Disc 420

The rotary disc 420 is a circular disc-shaped member fabricated of resin. The rotary disc 420 conveys coins in the separation housing 410 by rotating. The rotary disc 420 is disposed inside the separation housing 410 and rotates horizontally over the housing floor face 412. The rotary disc 420 receives rotary driving force from the disc driving section 430, and rotates in a predetermined rotation direction with the rotation centered on a rotary shaft 426 that is fixed to the rotary disc 420.

Figure 5:
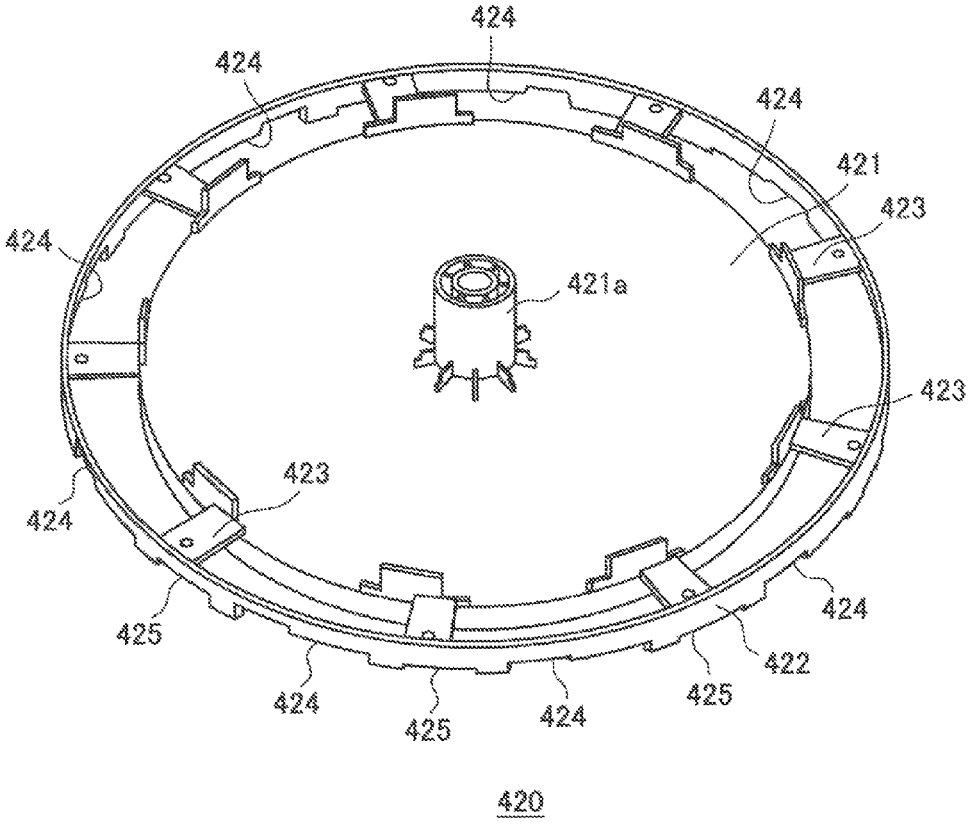
FIG. 5 is a perspective view in which a rotary disc 420 in accordance with the first embodiment is seen from an upper side.
Figure 6:
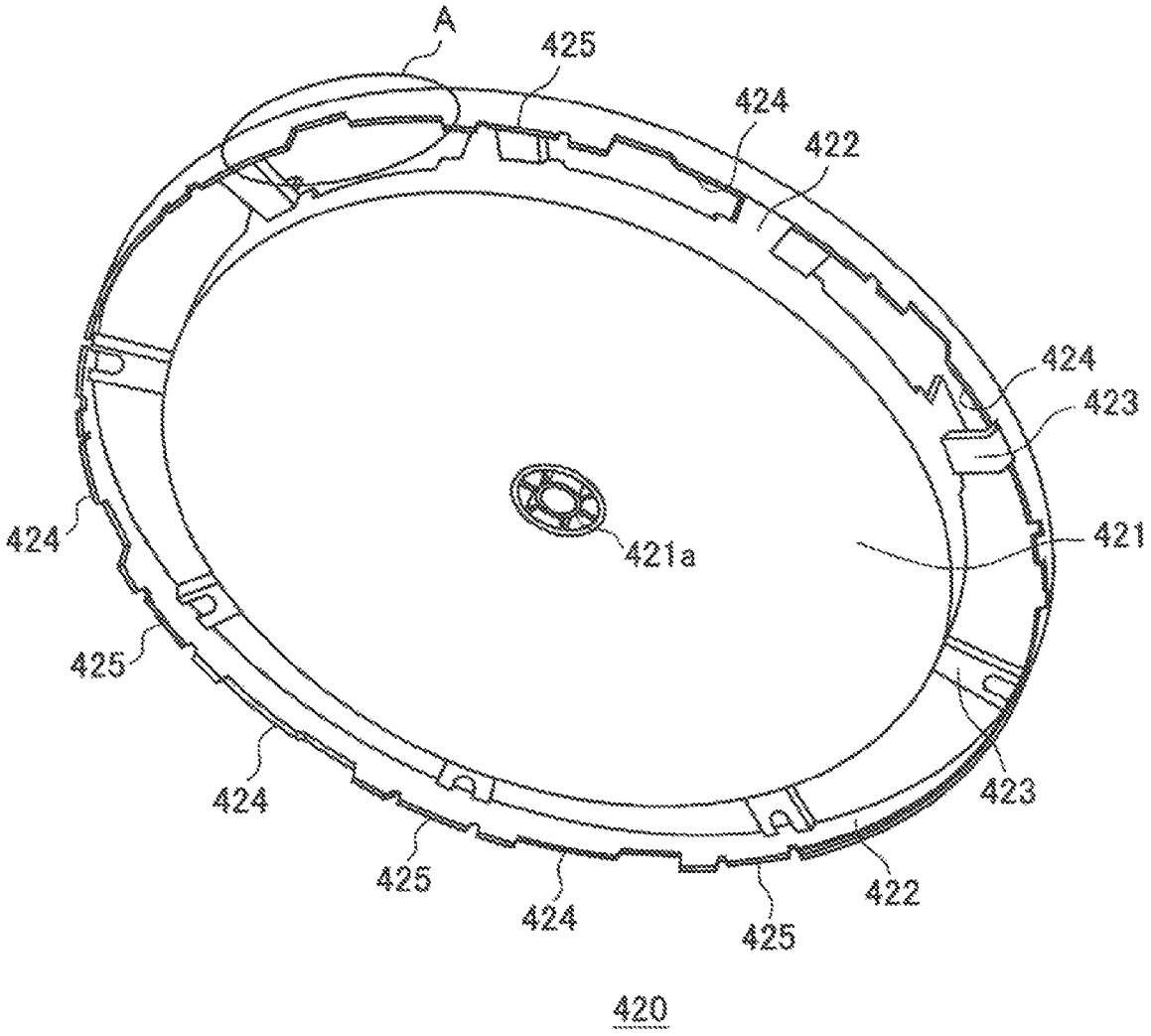
FIG. 6 is a perspective view in which the rotary disc 420 in accordance with the first embodiment is seen from the lower side.
Figure 7:
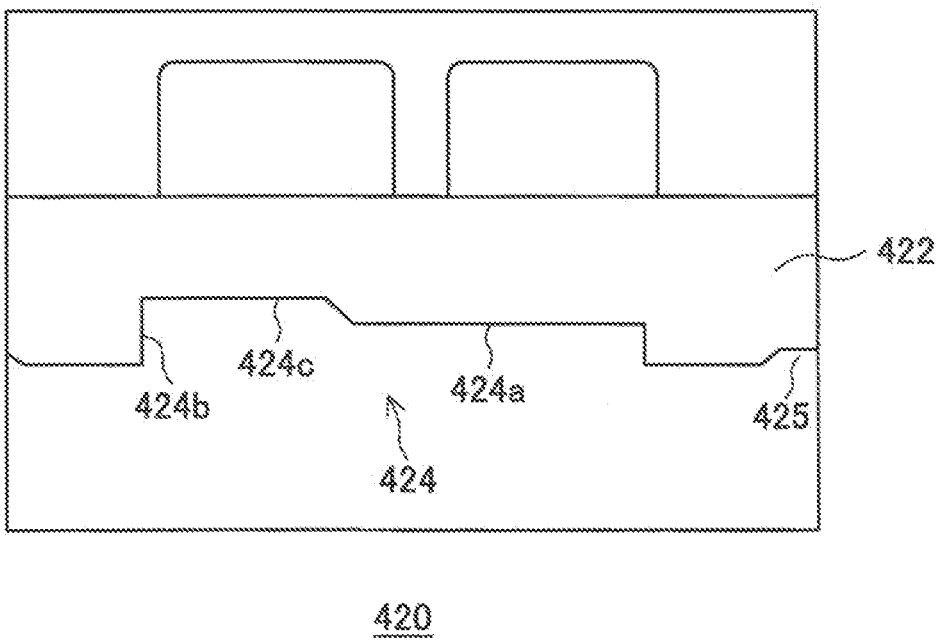
FIG. 7 is a diagram in which area A in FIG. 6 is magnified.

Now, detailed structure of the rotary disc 420 is described referring to FIG. 5 to FIG. 7. FIG. 5 is a perspective view in which the rotary disc 420 in accordance with the first embodiment is seen from the upper side. FIG. 6 is a perspective view in which the rotary disc 420 in accordance with the first embodiment is seen from the lower side. FIG. 7 is a diagram in which area A in FIG. 6 is magnified, showing a conveyance indentation portion 424.

Figure 9:
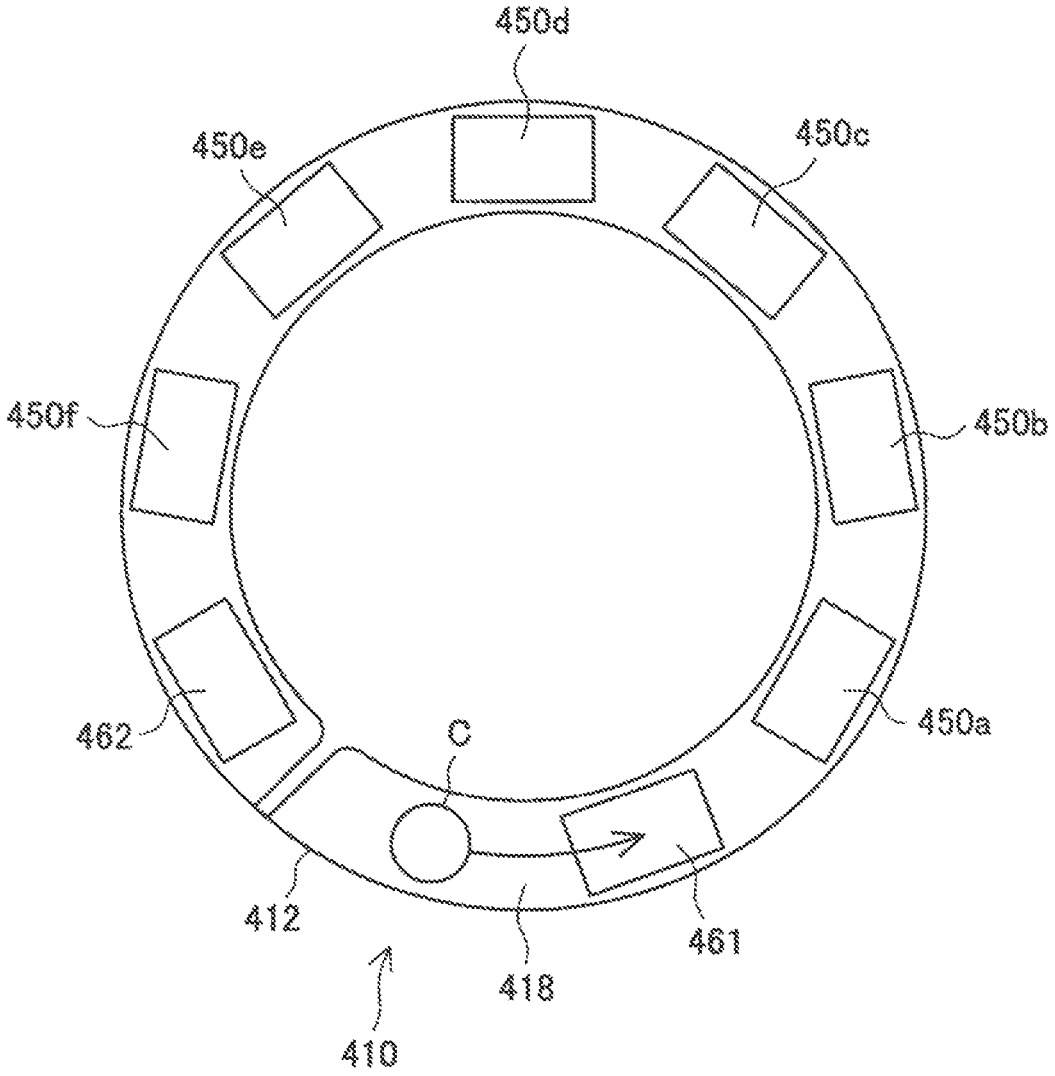
FIG. 9 is a schematic diagram for describing positional relationships between coin ejection apertures 450*a* to 450*f*, a first reject aperture 461 and a second reject aperture 462.

By rotating, the rotary disc 420 conveys a coin over a conveyance path 418 of the housing floor face 412 (see FIG. 9). As shown in FIG. 5 and FIG. 6, the rotary disc 420 includes a disc portion 421, an annular rib 422, linking portions 423, the conveyance indentation portions 424, and weight reduction cutaway portions 425.

The disc portion 421 is a flat plate-shaped portion that is disposed at the center side of the rotary disc 420. The disc portion 421 is disposed inside the separation housing 410 so as to be parallel with the housing floor face 412. A fitting portion 421*a* that fits onto the rotary shaft 426 is provided at the center of the disc portion 421.

The annular rib 422 is a rib that is provided at an outer periphery portion of the rotary disc 420 in an annular shape in the circumferential direction. The annular rib 422 is provided to be separated from the disc portion 421 in the radial direction of the rotary disc 420 by a predetermined spacing. A width of the annular rib 422 in the axial direction of the rotary disc 420 is greater than a width (thickness) thereof in the radial direction of the rotary disc 420.

The linking portions 423 are plate-shaped portions that link side faces of the disc portion 421 with the annular rib 422. The linking portions 423 are provided at predetermined intervals in the circumferential direction of the rotary disc 420. That is, the linking portions 423 are arranged in a radial pattern as viewed from the center of the rotary disc 420.

The conveyance indentation portions 424 are indentation portions formed in a floor portion of the annular rib 422. As shown in FIG. 5 and FIG. 6, the conveyance indentation portions 424 are plurally provided at predetermined intervals in the circumferential direction. As the rotary disc 420 rotates, the conveyance indentation portions 424 convey coins one by one while retaining the coins. As shown in FIG. 7, each conveyance indentation portion 424 includes a retention portion 424*a*, which is an example of a coin conveyance portion, a conveyance wall 424*b* and a release portion 424*c*.

The retention portion 424*a* is a portion that is indented in a rectangular shape. As the rotary disc 420 rotates, the retention portion 424*a* conveys a coin while constraining movements of the coin. A circumferential direction width of the retention portion 424*a* is specified to be slightly larger than the diameter of the coin with the largest diameter among the plural coins with different diameters. A depth of the retention portion 424*a* is specified to be substantially the same as a thickness of the coins.

During the rotation of the rotary disc 420, the conveyance wall 424*b* conveys the coin by touching the coin and pushing the coin. The conveyance wall 424*b* is a wall of the conveyance indentation portion 424 at the downstream side in the conveyance direction of the rotary disc 420.

The release portion 424*c* is a portion of the retention portion 424*a* that is indented more deeply, at a portion at the conveyance direction upstream side of the retention portion 424*a*. That is, the conveyance indentation portion 424 is formed in a stepped shape as shown in FIG. 7. When a coin conveyed by the conveyance wall 424*b* is tipping diagonally into one of the coin ejection apertures 450*a* to 450*f* (or the first reject aperture 461 or second reject aperture 462), a portion of the coin may enter into the release portion 424*c*. As a result, incidences of a coin being gripped between walls at the two sides of the conveyance indentation portion 424 and locking when the coin is dropping into an ejection aperture may be prevented.

The weight reduction cutaway portions 425 are portions that are cut away to reduce the weight of the rotary disc 420. Incision amounts of the weight reduction cutaway portions 425 are smaller than incision amounts of the conveyance indentation portions 424. Each of the weight reduction cutaway portions 425 is formed between two of the conveyance indentation portions 424 that neighbor one another in the circumferential direction. That is, the weight reduction cutaway portions 425 and the conveyance indentation portions 424 are provided alternately in the circumferential direction.

The effects of inertia due to the weight of the rotary disc 420 are suppressed by reducing the weight of the rotary disc 420. Thus, a stopping time of the intermittently rotating rotary disc 420 may be shortened.

Figure 8:
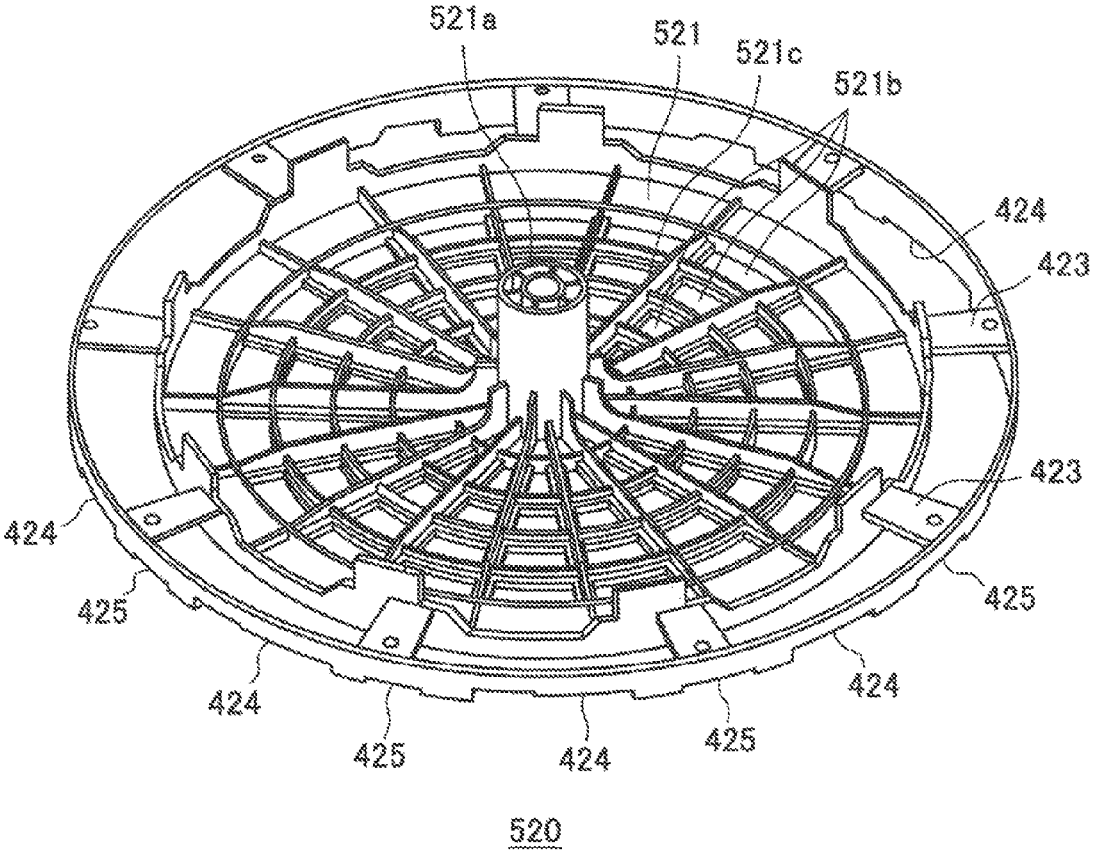
FIG. 8 is a perspective view in which a rotary disc 520 in accordance with a variant example is seen from the upper side.

The form of the rotary disc 420 is not limited to the structure described above. For example, a form as illustrated in FIG. 8 is possible. FIG. 8 is a perspective view in which a rotary disc 520 in accordance with a variant example is seen from the upper side. The structure of the rotary disc 520 according to the variant example differs from the structures of the above-described rotary disc 420 and disc portion 421, whereas other structures are similar. Now, the structure of a disc portion 521 of the rotary disc 520 according to the variant example is described.

As shown in FIG. 8, numerous holes 521*b* and reinforcing ribs 521*c* are formed in the disc portion 521 according to the variant example. The holes 521*b* are formed in a radial pattern as seen from the center of the disc portion 521 (a fitting portion 521*a*), with sets of four of the holes 521*b* being formed in the radial direction. The reinforcing ribs 521*c* are formed in the radial direction. Because the numerous holes 521*b* are provided, the rotary disc 520 may be reduced in weight, and because the rotary disc 520 is reduced in weight, stopping positions of the rotary disc 520 may be more easily controlled.

The size of each hole 521*b* is specified to be smaller than the diameter of the coin with the smallest expected diameter. Therefore, even if a coin accidentally falls onto the rotary disc 520 from above in the coin processing device 10, the coin stays on the rotary disc 520. Consequently, the removal of accidentally dropped coins is easy.

The Disc Driving Section 430

The disc driving section 430 is a driving section that drives the rotary disc 420 to rotate. As shown in FIG. 4, the disc driving section 430 includes a disc motor 432 and a gear train 434. The disc motor 432 transmits rotary driving force through the gear train 434, rotating the rotary shaft 426. Hence, the rotary disc 420 to which the rotary shaft is fixed rotates in the same direction as the rotation direction of the rotary shaft 426. Herein, the disc driving section 430 transmits the rotary driving force such that the rotary disc 420 rotates intermittently.

The Position Detection Section 440

The position detection section 440 is a member for detecting rotation positions of the rotary disc 420. As shown in FIG. 3, the position detection section 440 includes a tube member 442 and a detection sensor 444.

The tube member 442 is disposed to be coaxial with the rotary disc 420. Plural slits 443 are formed at a predetermined angular pitch in an upper face of the tube member 442. The detection sensor 444 is a sensor that detects passage of the slits 443 when the rotary disc 420 is rotating. As an example, the detection sensor 444 is an optical sensor that includes a light-emitting portion and a light-detecting portion that are opposingly disposed so as to sandwich the tube member 442.

The Coin Ejection Apertures 450*a* to 450*f*

The coin ejection apertures 450*a* to 450*f* are ejection apertures formed in the housing floor face 412 of the separation housing 410. During the rotation of the rotary disc 420, coins of respectively different denominations drop into the six coin ejection apertures 450*a* to 450*f* (for example, authentic 1 yen, 5 yen, 10 yen, 50 yen, 100 yen and 500 yen coins). Hence, the coins may be paid out in the respective denominations.

FIG. 9 is a schematic diagram for describing positional relationships between the coin ejection apertures 450*a* to 450*f*, the first reject aperture 461 and the second reject aperture 462. As shown in FIG. 9, the coin ejection apertures 450*a* to 450*f* are formed in the conveyance path 418 of the housing floor face 412 at predetermined intervals in the conveyance direction of the rotary disc 420. The openings of the coin ejection apertures 450*a* to 450*f* are specified to be larger than the coin with the largest diameter. The center of each coin ejection aperture and the annular rib 422 are disposed at substantially the same position in the radial direction of the rotary disc 420. As a result, it is easier for coins being conveyed by the annular rib 422 to drop into the coin ejection apertures 450*a* to 450*f*.

As an example, guides are provided at both sides of the conveyance path 418 and the coins are conveyed along the conveyance path 418 as the rotary disc 420 rotates. While there are six of the coin ejection apertures in the above description, this is not a limitation; there may be five or less.

The First Reject Aperture 461

The first reject aperture 461 is an ejection aperture formed in the conveyance path 418 of the separation housing 410. As shown in FIG. 9, the first reject aperture 461 is disposed at the upstream side of the six coin ejection apertures 450*a* to 450*f* in the conveyance direction of the rotary disc 420 (the circumferential direction).

The first reject aperture 461 is an ejection aperture that ejects reject coins verified as being counterfeit by the coin verification section 30, foreign bodies such as trash and the like, and so forth. Because reject coins and foreign bodies are ejected at the first reject aperture 461 that is disposed at the conveyance direction upstream side relative to the coin ejection apertures 450*a* to 450*f*, incidences of reject coins and foreign bodies being accidentally ejected through the coin ejection apertures 450*a* to 450*f* may be prevented.

The Second Reject Aperture 462

The second reject aperture 462 is an ejection aperture formed in the conveyance path 418 of the separation housing 410. As shown in FIG. 9, the second reject aperture 462 is disposed at the downstream side of the six coin ejection apertures 450*a* to 450*f* in the conveyance direction of the rotary disc 420 (the circumferential direction).

The second reject aperture 462 is an ejection aperture that, when a coin that should be ejected through one of the coin ejection apertures 450*a* to 450*f* is not ejected through the coin ejection apertures 450*a* to 450*f*, ejects the coin that has passed the coin ejection apertures 450*a* to 450*f*. Blocking ("jamming") of the coin separation section 40 by coins that have not been ejected at the coin ejection apertures 450*a* to 450*f* may be prevented by the provision of the second reject aperture 462.

The Ejection Aperture Opening-And-Closing Plates 470*a* to 470*f*

Figure 11:
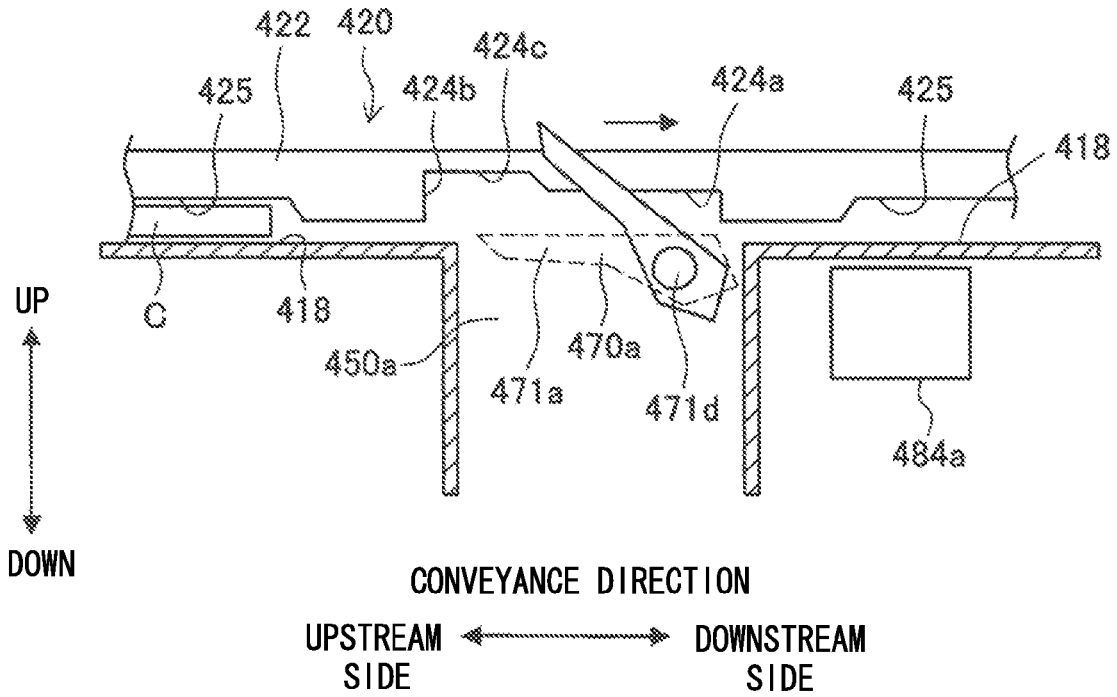
FIG. 11 is a schematic diagram showing open and closed positions of the ejection aperture opening-and-closing plate 470*a*.

Each of the ejection aperture opening-and-closing plates 470*a* to 470*f* opens and closes the respectively corresponding one of the coin ejection apertures 450*a* to 450*f* by turning about a turning shaft 471*d* (see FIG. 11). Each of the ejection aperture opening-and-closing plates 470*a* to 470*f* turns between a closed position, at which that one of the ejection aperture opening-and-closing plates 470*a* to 470*f* closes off the corresponding one of the coin ejection apertures 450*a* to 450*f*, and an open position, at which the corresponding one of the coin ejection apertures 450*a* to 450*f* is opened up.

Figure 10:
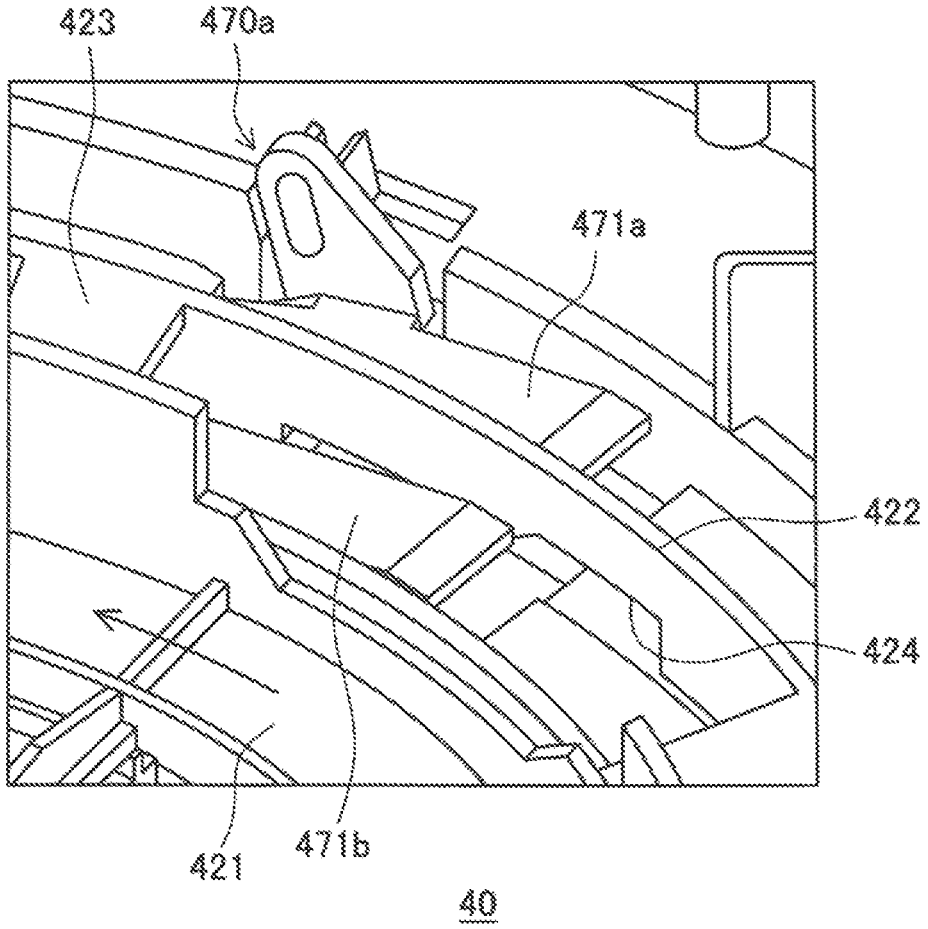
FIG. 10 is a perspective view showing an ejection aperture opening-and-closing plate 470*a* and surrounding structures.

The six ejection aperture opening-and-closing plates 470*a* to 470*f* have matching structures. Herebelow, the structure of the ejection aperture opening-and-closing plate 470*a* is described referring to FIG. 10 and FIG. 11. FIG. 10 is a perspective view showing the ejection aperture opening-and-closing plate 470*a* and surrounding structures. FIG. 11 is a schematic diagram showing the open and closed positions of the ejection aperture opening-and-closing plate 470*a*.

The ejection aperture opening-and-closing plate 470*a* is formed in a bifurcated shape as shown in FIG. 10, with a first plate portion 471*a*, which is an example of a second opening-and-closing plate, and a second plate portion 471*b*, which is an example of a first opening-and-closing plate. As shown in FIG. 10, the first plate portion 471*a* is disposed at the outer side in the radial direction relative to the annular rib 422, and the second plate portion 471*b* is disposed at the center side in the radial direction relative to the annular rib 422. To prevent interference between the second plate portion 471*b* and the rotary disc 420, a spacing between the disc portion 421 and the annular rib 422 is a little larger than the width of the second plate portion 471*b*.

As shown in FIG. 11, the ejection aperture opening-and-closing plate 470*a* (the first plate portion 471*a* and the second plate portion 471*b*) turns about the turning shaft 471*d* that is disposed at the conveyance direction downstream side of the coin ejection aperture 450*a*. By turning, the ejection aperture opening-and-closing plate 470*a* is disposed at the closed position at which the ejection aperture opening-and-closing plate 470*a* closes off the coin ejection aperture 450*a* (the position shown by broken lines in FIG. 11) and the open position at which the coin ejection aperture 450*a* is opened up (the position shown by solid lines in FIG. 11).

When the ejection aperture opening-and-closing plate 470*a* is disposed at the closed position, because the first plate portion 471*a* and the second plate portion 471*b* cover the coin ejection aperture 450*a*, coins are not ejected through the coin ejection aperture 450*a* but pass over the ejection aperture opening-and-closing plate 470*a*. On the other hand, when the ejection aperture opening-and-closing plate 470*a* is disposed at the open position, the first plate portion 471*a* and the second plate portion 471*b* leave the coin ejection aperture 450*a* open, so coins drop into the coin ejection aperture 450*a* and are ejected. When at the open position, the first plate portion 471*a* and second plate portion 471*b* cross the annular rib 422. The ejection aperture opening-and-closing plate 470*a* includes the function of guiding a coin to drop into the coin ejection aperture 450*a*.

When the ejection aperture opening-and-closing plate 470*a* is disposed at the open position, distal end portions of the first plate portion 471*a* and second plate portion 471*b* (i.e., portions at the opposite sides thereof from the turning shaft 471*d*) are disposed higher than the annular rib 422 in the up-and-down direction, as shown in FIG. 11. Hence, because the above-described first plate portion 471*a* and second plate portion 471*b* are disposed at (in the vicinities of) the two sides of the annular rib 422 in the radial direction, the rotary disc 420 may continue rotating even in the state in which the ejection aperture opening-and-closing plate 470*a* is disposed at the open position. Therefore, a coin may be ejected into the coin ejection aperture 450*a* while the rotary disc 420 is rotating, and coin separation and ejection processing may be made quicker.

The Reject Aperture Opening-And-Closing Plate 474

As shown in FIG. 14, the reject aperture opening-and-closing plate 474 opens and closes the first reject aperture 461 by turning. The reject aperture opening-and-closing plate 474 turns between a closed position at which the reject aperture opening-and-closing plate 474 closes off the first reject aperture 461 and an open position at which the first reject aperture 461 is opened up. The structures and operation of the reject aperture opening-and-closing plate 474 are the same as the structure and operation of the ejection aperture opening-and-closing plate 470*a* described above, so are not described in detail here.

When the reject aperture opening-and-closing plate 474 is disposed at the closed position, coins being conveyed by the rotary disc 420 pass over the reject aperture opening-and-closing plate 474. When the reject aperture opening-and-closing plate 474 is disposed at the open position, a reject coin or foreign body being conveyed by the rotary disc 420 is guided by the reject aperture opening-and-closing plate 474, and thus drops into the first reject aperture 461 and is ejected.

The Reject Aperture Guide 476

Figure 12:
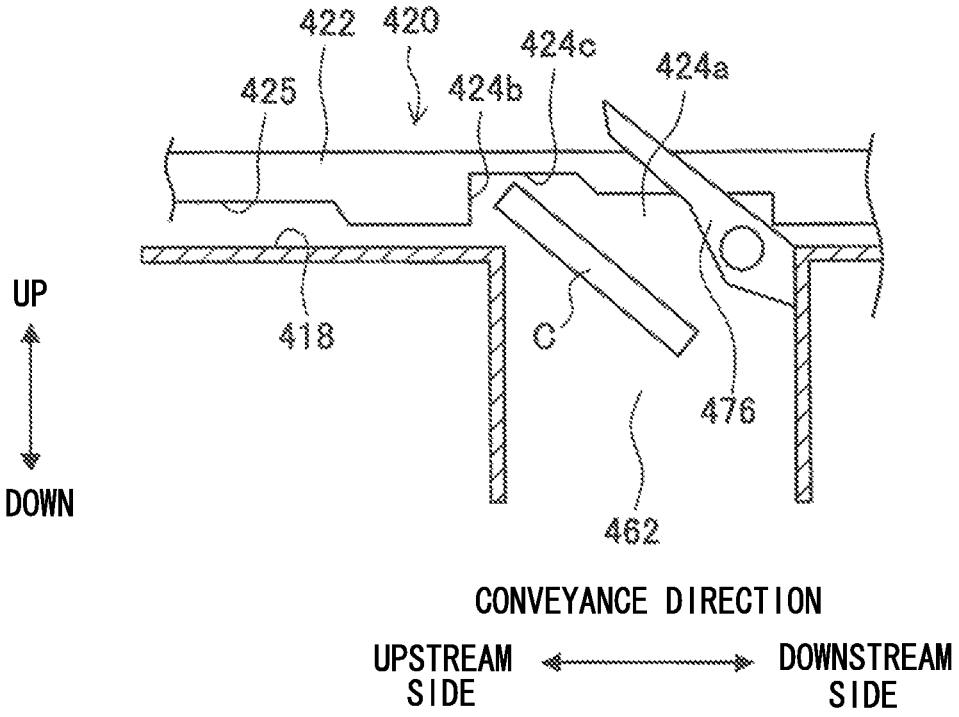
FIG. 12 is a diagram showing a reject aperture guide 476 and surrounding structures.

As shown in FIG. 12, the reject aperture guide 476 guides coins to drop into the second reject aperture 462. Unlike the reject aperture opening-and-closing plate 474 that opens and closes, the reject aperture guide 476 is a fixed guide. The reason for the reject aperture guide 476 being a fixed guide is that all coins reaching the second reject aperture 462 are to be ejected, so there is no need for a structure that closes off the second reject aperture 462. FIG. 12 is a diagram showing the reject aperture guide 476 and surrounding structures.

The Feed-in Detection Sensor 480

The feed-in detection sensor 480 is disposed in the vicinity of the feed-in aperture 415 shown in FIG. 4, and detects coins C that are conveyed into the coin separation section 40 through the feed-in aperture 415. The feed-in detection sensor 480 is, as an example, a magnetic sensor.

The Foreign Body Detection Sensor 482

The foreign body detection sensor 482 detects whether or not a reject coin, foreign body or the like that was intended to be ejected through the first reject aperture 461 actually has been ejected through the first reject aperture 461. As shown in FIG. 3, the foreign body detection sensor 482 is disposed between the first reject aperture 461 and the coin ejection aperture 450*a* in the coin conveyance direction of the rotary disc 420.

The foreign body detection sensor 482 is, as an example, an optical sensor. Therefore, foreign bodies such as trash and the like may be detected as well as reject coins. When a reject coin, foreign body or the like has been ejected through the first reject aperture 461, the foreign body detection sensor 482 does not detect that reject coin, foreign body or the like. On the other hand, when a reject coin, foreign body or the like has not been ejected through the first reject aperture 461, the foreign body detection sensor 482 detects that the reject coin, foreign body or the like has passed the first reject aperture 461.

No foreign body detection sensor is provided at the conveyance direction downstream side of the second reject aperture 462. This is because, in contrast with the first reject aperture 461, all coins and the like reaching the second reject aperture 462 are ejected through the second reject aperture 462, and there are no coins or the like that pass the second reject aperture 462.

The Coin Detection Sensors 484*a* to 484*f*

The coin detection sensors 484*a* to 484*f* detect whether or not coins that should be ejected through the corresponding coin ejection apertures among the six coin ejection apertures 450*a* to 450*f* are actually ejected through these coin ejection apertures.

As shown in FIG. 3, the six coin detection sensors 484*a* to 484*f* are disposed at the conveyance direction downstream sides of the corresponding coin ejection apertures 450*a* to 450*f*. For example, the coin detection sensor 484*a* is disposed between the coin ejection aperture 450*a* and the coin ejection aperture 450*b* in the conveyance direction of the rotary disc 420.

In contrast to the foreign body detection sensor 482 that is an optical sensor, the coin detection sensors 484*a* to 484*f* are, as an example, magnetic sensors. When a coin has been ejected from a corresponding coin ejection aperture, the coin detection sensor disposed at the conveyance direction downstream side of that coin ejection aperture does not detect that coin. On the other hand, in a case in which the coin is not ejected from that one of the coin ejection apertures, that coin detection sensor detects that the coin has passed the coin ejection aperture. Because a variety of sensors in accordance with detection targets are used as the above described foreign body detection sensor 482 and coin detection sensors 484*a* to 484*f*, a high detection accuracy is possible.

1-5. Operations of the Coin Processing Device

Now, an operation example of the coin processing device 10 with the structure described above is described. Herebelow, an operation example of the coin processing device 10 from coins being inserted to the coins being separated and ejected is described. The operation of the coin processing device 10 is implemented by the control section of the control unit 90. That is, the control section implements the operations described below by executing a program stored in the storage section.

First, a batch of coins are inserted into the coin receiving portion 210 of the coin feeding section 20, and the inserted coins are stacked on the turning disc 230. Then, when the turning disc 230 rotates, the coins on the turning disc 230 are subjected to centrifugal force due to the rotation and move along the inner periphery face of the accommodation portion 220, and are pushed out through the passage aperture 222 to the conveyance path 310 of the coin verification section 30 one at a time.

Figure 13A:
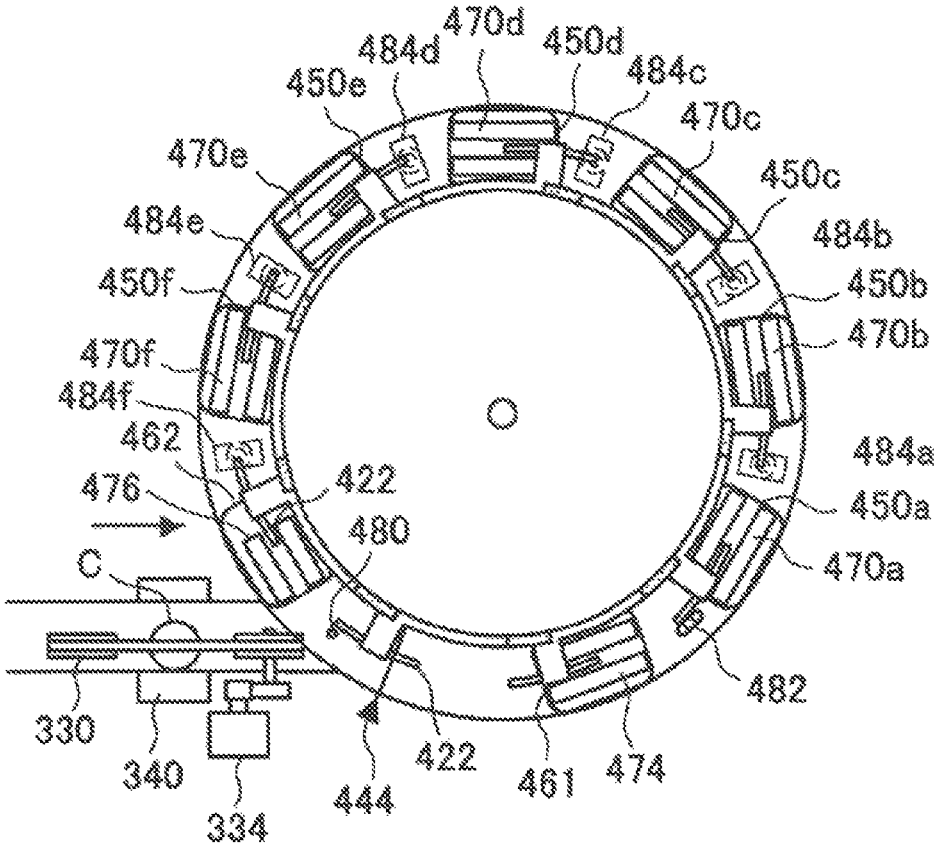
FIG. 13A to FIG. 13E are diagrams showing a flow of processing in which, after a coin has been verified at the coin verification section 30, the coin is fed into the coin separation section 40.

FIG. 13A to FIG. 13E are diagrams showing a flow of processing in which, after a coin has been verified at the coin verification section 30, the coin is fed into the coin separation section 40. A coin pushed out to the conveyance path 310 is conveyed by the conveyance belt 330, and the authenticity, denomination and the like of the coin are verified by the verification sensor 340, as shown in FIG. 13A. The verification sensor 340 outputs the verification results to the control unit 90. On the basis of the received verification results, the control unit 90 determines which coin ejection aperture of the six coin ejection apertures 450*a* to 450*f* the verified coin is to be ejected through.

Figure 13B:
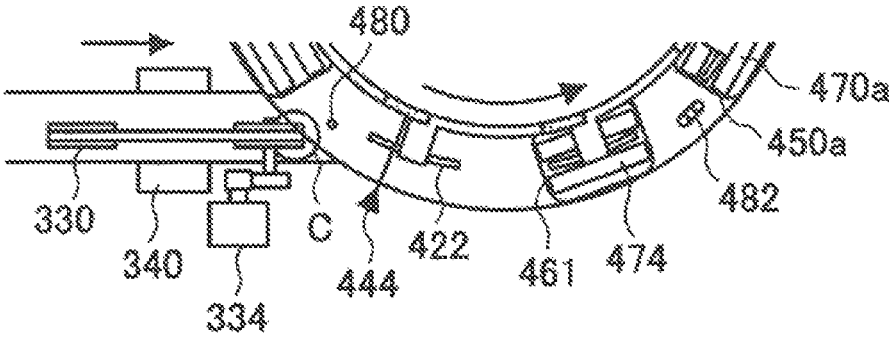

After the verification, as shown in FIG. 13B, the coin is conveyed further by the conveyance belt 330, and is conveyed through the feed-in aperture 415 of the coin separation section 40 into the separation housing 410. At this time, the rotation of the rotary disc 420 of the coin separation section 40 is paused.

Figure 13C:
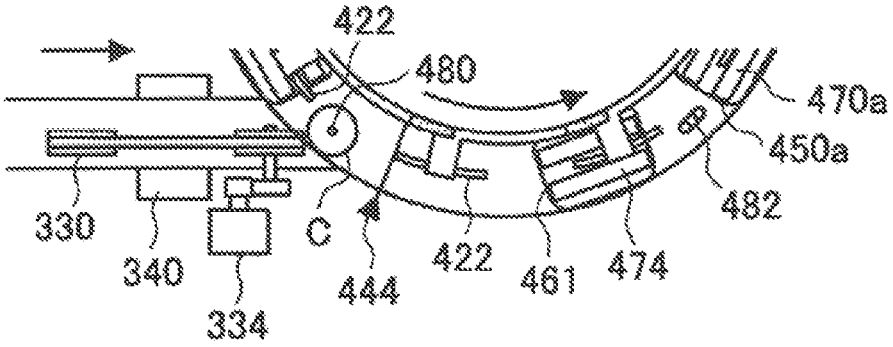
Figure 13D:
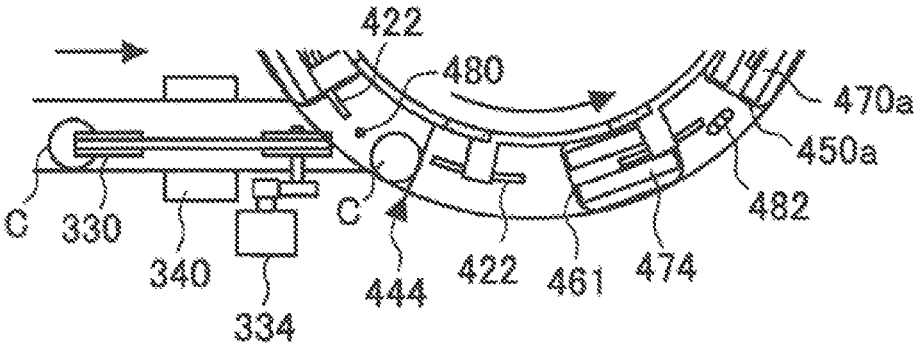
Figure 13E:
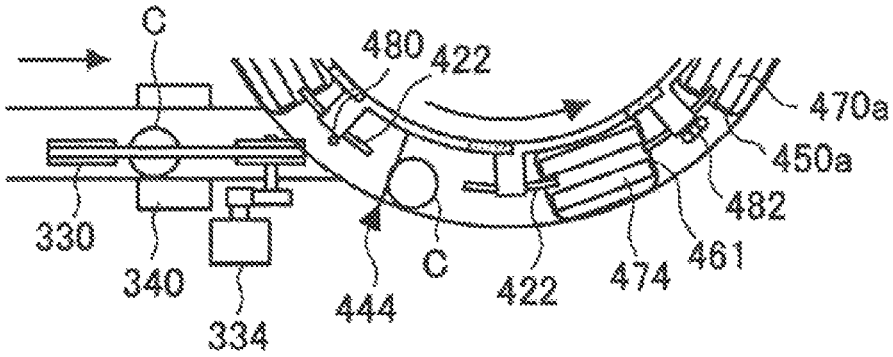

As shown in FIG. 13C, the feeding in of the coin that has been fed into the separation housing 410 is detected by the feed-in detection sensor 480. When the coin is detected by the feed-in detection sensor 480, as shown in FIG. 13D and FIG. 13E, the rotary disc 420 resumes rotation. Accordingly, the annular rib 422 of the rotary disc 420 conveys the coin.

The coin being conveyed by the rotary disc 420 is ejected through the coin ejection aperture determined by the control unit 90. Herein, as described above, the coin verification section 30 and the coin separation section 40 of the present embodiment are separately arranged. Therefore, even if time is required for processing by the verification sensor 340, the ejection destination coin ejection aperture may be determined before the coin is fed into the coin separation section 40. Accordingly, the coin ejection apertures may be disposed closer to the feed-in aperture than in a case in which a verification sensor is disposed in a coin separation section. Hence, the coin separation section may be reduced in size.

Herebelow, a flow of coin ejection processing is described, in which a coin passes the first reject aperture 461 and is ejected through the coin ejection aperture 450*a*.

Figure 14A:
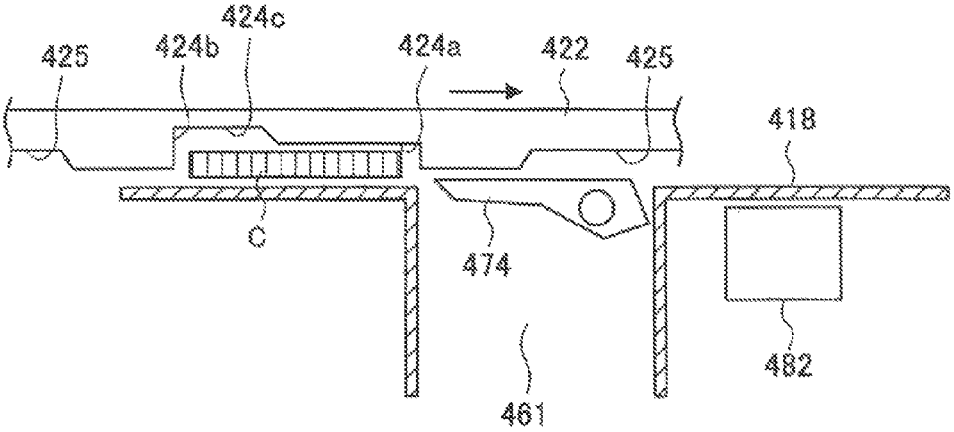
FIG. 14A to FIG. 14C are diagrams describing the flow of a coin passing the first reject aperture 461.
Figure 14B:
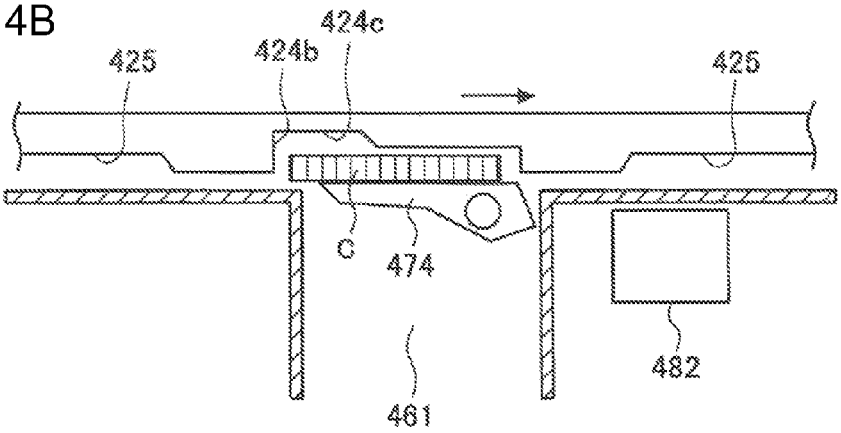
Figure 14C:
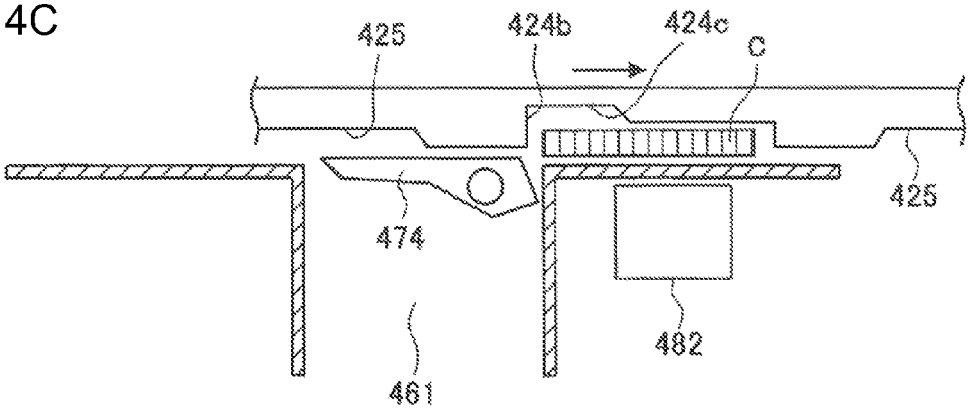

FIG. 14A to FIG. 14C are diagrams describing the flow of the coin passing the first reject aperture 461. Because the coin is not to be ejected through the first reject aperture 461, as shown in FIG. 14A, the reject aperture opening-and-closing plate 474 is disposed at the closed position, closing the first reject aperture 461. As shown in FIG. 14B, the coin being conveyed by the rotary disc 420 passes over the reject aperture opening-and-closing plate 474 that is disposed in the closed position. Thereafter, the coin passes over the foreign body detection sensor 482. While the coin is disposed above the foreign body detection sensor 482, rotation of the rotary disc 420 pauses. A succeeding coin is fed in during this pause of the rotary disc 420.

Figure 15A:
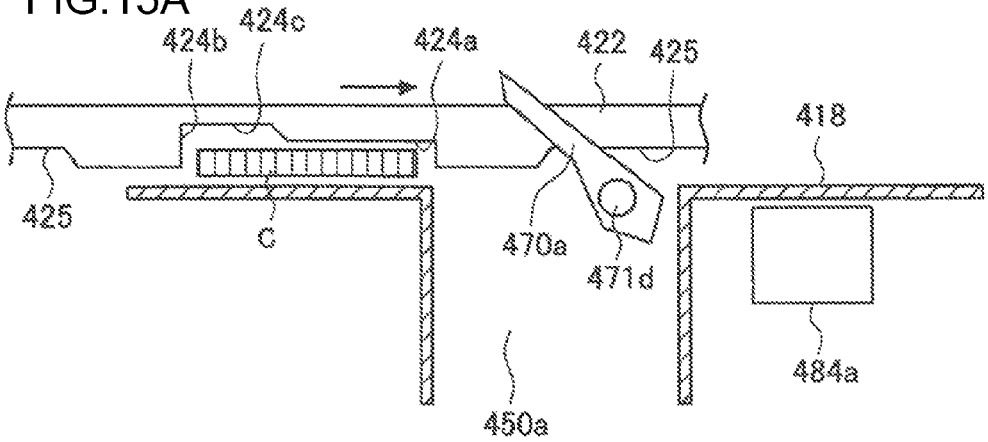
FIG. 15A to FIG. 15C are diagrams describing the flow of a coin being ejected through the coin ejection aperture 450*a*.
Figure 15B:
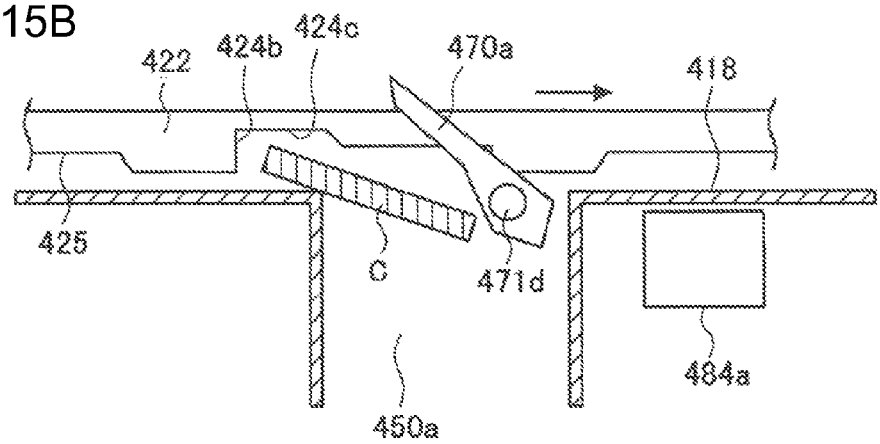
Figure 15C:
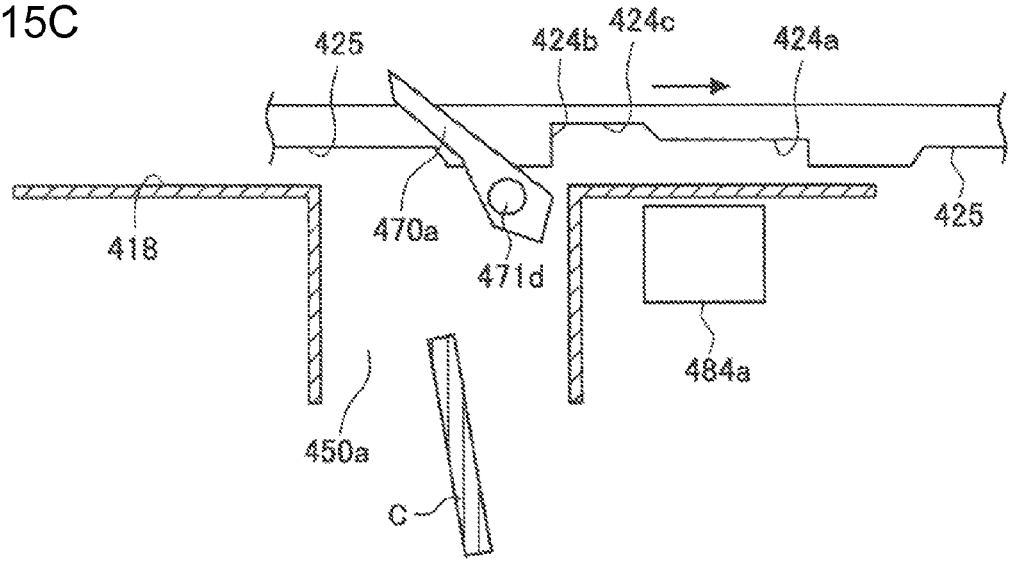

FIG. 15A to FIG. 15C are diagrams describing the flow of a coin being ejected through the coin ejection aperture 450*a*. Because the coin is to be ejected through the coin ejection aperture 450*a*, as shown in FIG. 15A, the ejection aperture opening-and-closing plate 470*a* is disposed at the open position, opening up the coin ejection aperture 450*a*. As shown in FIG. 15B, the coin being conveyed by the rotary disc 420 starts to drop into the coin ejection aperture 450*a* while the rotary disc 420 is rotating. At this time, a portion of the coin temporarily enters the release portion 424*c*, after which the coin drops into the coin ejection aperture 450*a*.

Thereafter, as shown in FIG. 15C, the coin falls into the coin ejection aperture 450*a* and is ejected. When the coin has been ejected through the coin ejection aperture 450*a*, the coin is not detected by the coin detection sensor 484*a*. Thus, the control unit 90 detects that the coin has been ejected through the coin ejection aperture 450*a*.

In a case in which the ejection aperture opening-and-closing plate 470*a* is not disposed at the open position, due to mis-operation or the like, and the coin does not drop into the coin ejection aperture 450*a*, the coin is detected by the coin detection sensor 484*a*. When the coin detection sensor 484*a* detects the coin, this detection result is outputted to the control unit 90. The coin that has not been ejected through the coin ejection aperture 450*a* is subsequently conveyed by the rotary disc 420 and ejected through the second reject aperture 462.

In the above description, a case is described in which an authentic coin is verified by the verification sensor 340. However, when a reject coin, a foreign body or the like is verified, the following operation is executed. When the reject coin, foreign body or the like is verified by the verification sensor 340, the reject aperture opening-and-closing plate 474 is disposed at the open position and the reject coin, foreign body or the like is ejected through the first reject aperture 461 during the rotation of the rotary disc 420.

The coin processing device 10 carries out the processing described above for all of the inserted coins. When the verification and separation of the coins inputted in the batch has been completed, the present operation ends.

1-6. Effectiveness of the Coin Processing Device

As described hereabove, in the coin processing device 10, the ejection aperture opening-and-closing plates 470*a* to 470*f* turn about the turning shafts 471*d* at the conveyance direction downstream sides of the coin ejection apertures 450*a* to 450*f*, to be disposed at the open positions crossing the annular rib 422. Therefore, a coin may easily drop into one of the coin ejection apertures 450*a* to 450*f* even during turning of that ejection aperture opening-and-closing plate 470*a* to 470*f* from the closed position to the open position. Thus, even if the rotation speed of the rotary disc 420 is fast and the opening and closing operations of the ejection aperture opening-and-closing plates 470*a* to 470*f* are slow, the coins may be appropriately ejected.

When the ejection aperture opening-and-closing plates 470*a* to 470*f* are disposed at the open positions, the ejection aperture opening-and-closing plates 470*a* to 470*f* are disposed in the vicinity of the annular rib 422 in the radial direction of the rotary disc 420, and allow rotation of the rotary disc 420. Therefore, the rotation of the rotary disc 420 may continue even when the ejection aperture opening-and-closing plates 470*a* to 470*f* are disposed at the open positions. Thus, coins may be dropped through the coin ejection apertures 450*a* to 450*f* while the rotary disc 420 is rotating.

The reject aperture opening-and-closing plate 474 that opens and closes the first reject aperture 461 exhibits the same operations and effects. That is, a reject coin, foreign body or the like drops through the first reject aperture 461 during the rotation of the rotary disc 420. Thus, according to the coin processing device 10 described above, coins being conveyed by the rotary disc 420 may be rapidly ejected through the coin ejection apertures 450*a* to 450*f* and the first reject aperture 461 during the rotation of the rotary disc 420.

2. Second Embodiment

Figure 16:
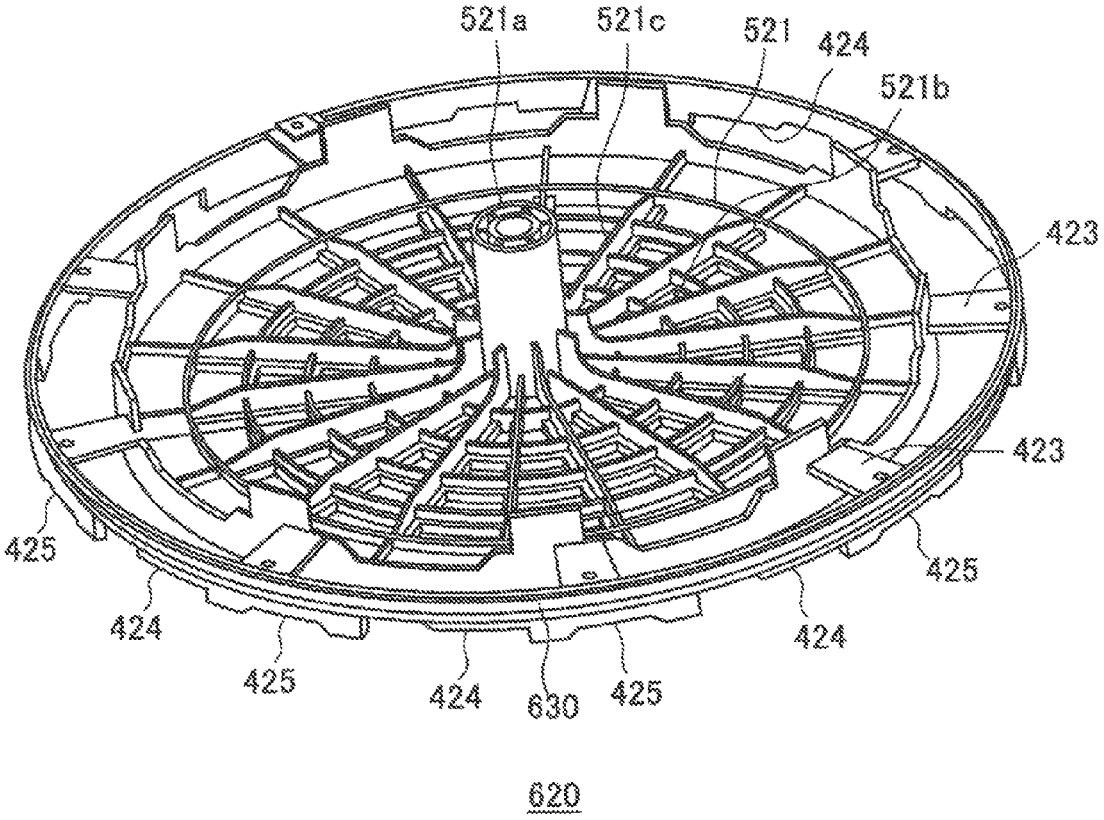
FIG. 16 is a perspective view in which a rotary disc 620 in accordance with a second embodiment is seen from an upper side.
Figure 17A:
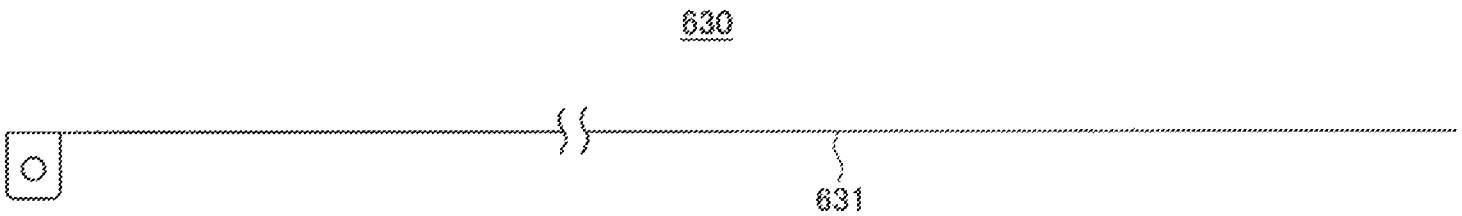
FIG. 17A and FIG. 17B are diagrams showing a film member 630.
Figure 17B:
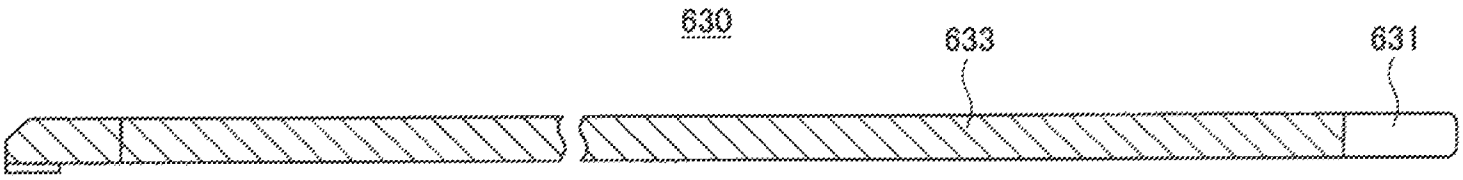

The structure of a rotary disc 620 according to a second embodiment is described referring to FIGS. 16 and 17. FIG. 16 is a perspective view in which the rotary disc 620 in accordance with the second embodiment is seen from the upper side. FIG. 17A and FIG. 17B are diagrams showing a film member 630.

The structure of the rotary disc 620 according to the second embodiment differs from the rotary disc 520 according to the variant example of the first embodiment, shown in FIG. 8, in that the film member 630, which is an example of an adhesive member, is wound and adhered onto an outermost periphery of the rotary disc 620. Other structures of the rotary disc 620 are the same as in the rotary disc 520, so the other structures are not described in detail here.

As shown in FIG. 16, the film member 630 covers the outer periphery of the annular rib 422 of the rotary disc 620 along the circumferential direction of the rotary disc 620. As shown in FIG. 17, the film member 630 includes a base material 631 and an adhesive layer 633. The base material 631 is formed of a resin film, for example, a polyethylene terephthalate film or the like. The adhesive layer 633 is formed of, for example, double-sided tape. The adhesive layer 633 is formed over substantially the whole area of the base material 631.

The film member 630 and the annular rib 422 are adhered together by the adhesive layer 633. In addition to the function of adhering the film member 630 to the annular rib 422, the adhesive layer 633 features the following function: if a portion of the annular rib 422 becomes broken, the adhesive layer 633 retains the broken portion, and thus separation of the broken portion from the annular rib 422 may be suppressed. Hence, the coin conveyance performance of the annular rib 422 may be maintained. A rotary disc 620 of which a portion of the annular rib 422 has broken can be replaced in periodic maintenance of the coin processing device 10.

The rotary disc 620 is fabricated of, for example, polycarbonate (PC). Thus, breakages of the rotary disc 620 may be suppressed. As a result, operational failures of the rotary disc 620 resulting from breakages of the disc may be prevented.

Preferable embodiments of the present invention have been described in detail while referring to the attached drawings, but the present invention is not limited by these examples. It will be clear to the practitioner having ordinary skill in the field of art to which the present invention belongs that numerous modifications and improvements are possible within the scope of the technical gist recited in the attached claims, and it should be understood that these modifications and improvements are to be encompassed by the technical scope of the invention.

In the above descriptions, each of the ejection aperture opening-and-closing plates 470*a* to 470*f* includes the first plate portion 471*a* and the second plate portion 471*b* that are disposed in the two vicinities of the annular rib 422 in the radial direction of the rotary disc 420, but this is not limiting. For example, the ejection aperture opening-and-closing plates 470*a* to 470*f* may include only one or other of the first plate portion 471*a* and the second plate portion 471*b*.

EXPLANATION OF THE REFERENCE NUMERALS

10 Coin processing device
20 Coin feeding section
30 Coin verification section
40 Coin separation section
90 Control unit
330 Conveyance belt
340 Verification sensor
410 Separation housing
415 Feed-in aperture
418 Conveyance path
420 Rotary disc
421 Disc portion
422 Annular rib
423 Linking portions
424 Conveyance indentation portion
424*a* Retention portion
424*b* Conveyance wall
424*c* Release portion
425 Weight reduction cutaway portions
430 Disc driving section
440 Position detection section
450*a*-450*f* Coin ejection apertures
461 First reject aperture
462 Second reject aperture
470*a*-470*f* Ejection aperture opening-and-closing plates
471*a* First plate portion
471*b* Second plate portion
471*d* Turning shaft
474 Reject aperture opening-and-closing plate
476 Reject aperture guide
480 Feed-in detection sensor
482 Foreign body detection sensor
484*a*-484*f* Coin detection sensors
520 Rotary disc
521 Disc portion
521*b* Holes
521*c* Reinforcing ribs
620 Rotary disc
630 Film member
631 Base material
633 Adhesive layer

The invention claimed is:

1. A coin processing device comprising:

a rotary member that conveys a coin along a conveyance path by rotating;

an ejection aperture disposed at the conveyance path, through which the coin being conveyed by the rotary member drops; and an opening-and-closing member that turns about a turning shaft between a closed position, at which the opening-and-closing member closes the ejection aperture, and an open position, at which the ejection aperture is opened up such that the coin drops therein, the turning shaft being disposed at a conveyance direction downstream side of the ejection aperture, wherein the rotary member includes an annular rib that is disposed in an annular shape along a circumferential direction at an outer periphery portion of the rotary member, the coin being conveyed along the conveyance path by an indentation portion formed in a floor portion of the annular rib, the open position is a position at which the opening-and-closing member crosses the annular rib, and when the opening-and-closing member is disposed at the open position, the opening-and-closing member is disposed in a vicinity of the annular rib in the radial direction of the rotary member and the opening-and-closing member allows rotation of the rotary member.

2. The coin processing device according to claim 1, wherein the opening-and-closing member comprises:

a first opening-and-closing plate that is disposed at the center side in the radial direction of the rotary member relative to the annular rib; and a second opening-and-closing plate that is disposed at the outer side in the radial direction relative to the annular rib, wherein, when the first opening-and-closing plate and the second opening-and-closing plate are at the open position, the first opening-and-closing plate and the second opening-and-closing plate cross the annular rib.

3. The coin processing device according to claim 1, wherein the indentation portion comprises:

a coin conveyance portion that is indented to a predetermined depth and conveys the coin; and a release portion at a portion of the coin conveyance portion at the conveyance direction upstream side thereof, the release portion being indented more deeply than the coin conveyance portion, and it being possible for a portion of the coin to enter the release portion when the coin is tipping and dropping at the ejection aperture.

4. The coin processing device according to claim 1, wherein the indentation portion is plurally provided in the annular rib at predetermined intervals along the circumferential direction, and the annular rib further includes a second indentation portion disposed between neighboring the indentation portions in the circumferential direction, an indentation amount of the second indentation portion being smaller than the indentation amount of the indentation portions.

5. The coin processing device according to claim 1, wherein the ejection aperture is a first ejection aperture at which authentic coins are ejected, and the coin processing device further includes:

a second ejection aperture that is disposed at the conveyance direction upstream side in the circumferential direction relative to the first ejection aperture, at least one of reject coins and foreign bodies being ejected at the second ejection aperture; and a third ejection aperture that is disposed at the conveyance direction downstream side in the circumferential direction relative to the first ejection aperture, coins that have not been ejected at the first ejection aperture being ejected at the third ejection aperture.

6. The coin processing device according to claim 1, further comprising:

an optical sensor disposed between the second ejection aperture and the first ejection aperture in the circumferential direction, the optical sensor being capable of detecting at least one of reject coins and foreign bodies intended to be ejected at the second ejection aperture; and a magnetic sensor disposed between the first ejection aperture and the third ejection aperture in the circumferential direction, the magnetic sensor being capable of detecting authentic coins intended to be ejected at the first ejection aperture.

7. The coin processing device according to claim 1, further comprising an adhesive member in which an adhesive layer is formed on a base material, wherein the adhesive member is adhered to the annular rib, via the adhesive layer, so as to cover an outer periphery of the annular rib.

8. The coin processing device according to claim 1, wherein the rotary member, the ejection aperture and the opening-and-closing member structure a portion of a separation unit that separates coins, the coin processing device further includes a verification unit that verifies the coins to be separated by the separation unit, and the separation unit further includes a feed-in aperture through which the coins verified by the verification unit are fed in.

* * * * *